US012747638B2

(12) United States Patent
Chen

(10) Patent No.: US 12,747,638 B2
(45) Date of Patent: Sep. 29, 2026

(54) CUTTING ELEMENT INCLUDING TWO OR MORE SHAPED CUTTING FEATURES, EACH HAVING A CONVEX AND INWARDLY/DOWNWARDLY ANGLED SHAPE

(71) Applicant: Halliburton Energy Services, Inc., Houston, TX (US)

(72) Inventor: Shilin Chen, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/953,496

(22) Filed: Nov. 20, 2024

(65) Prior Publication Data

US 2025/0179878 A1 Jun. 5, 2025

Related U.S. Application Data

(60) Provisional application No. 63/604,961, filed on Dec. 1, 2023.

(51) Int. Cl.
*E21B 10/567* (2006.01)

(52) U.S. Cl.
CPC ..... *E21B 10/5673* (2013.01)

(58) Field of Classification Search
CPC ..... E21B 10/5673; E21B 10/5676
See application file for complete search history.

(56) References Cited

U.S. PATENT DOCUMENTS

| | | | | |
|---|---|---|---|---|
| 5,172,778 | A * | 12/1992 | Tibbitts | E21B 10/5673 175/420.1 |
| D581,958 | S * | 12/2008 | Morozov | D15/139 |
| 10,125,552 | B2 | 11/2018 | Zhao et al. | |
| 10,399,206 | B1 | 9/2019 | Mortensen et al. | |
| 10,914,124 | B2 * | 2/2021 | Borge | C22C 26/00 |
| 11,085,243 | B2 | 8/2021 | Al-Masri et al. | |
| 11,215,012 | B2 | 1/2022 | Chen et al. | |
| 2019/0338599 | A1 * | 11/2019 | Bellin | E21B 10/55 |
| 2019/0376346 | A1 * | 12/2019 | Vijayabalan | E21B 10/46 |
| 2020/0018122 | A1 | 1/2020 | Keller et al. | |
| 2020/0032588 | A1 * | 1/2020 | Izbinski | E21B 10/5673 |
| 2020/0157890 | A1 * | 5/2020 | Cuillier De Maindreville | E21B 10/5673 |

(Continued)

FOREIGN PATENT DOCUMENTS

CN 105156036 B 1/2018

OTHER PUBLICATIONS

Dictionary definition of "convex", accessed via thefreedictionary.com.*

*Primary Examiner* — Blake Michener
(74) *Attorney, Agent, or Firm* — Michael Jenney; Parker Justiss, P.C.

(57) ABSTRACT

Provided is a cutting element, a drill bit, and a well system. The cutting element, in one aspect, includes a cutting section, the cutting element including a cutting section thickness ($t_c$) and a cutting face. The cutting element, according to one aspect, further includes two or more shaped cutting features extending from the cutting face, wherein each of the two or more shaped cutting features is convex shaped, but also angles inwardly and downwardly from a radial exterior point of its shaped cutting feature to a radial interior point of its shaped cutting feature.

23 Claims, 22 Drawing Sheets

(56) References Cited

U.S. PATENT DOCUMENTS

| | | | | |
|---|---|---|---|---|
| 2021/0009426 | A1* | 1/2021 | Fang | E21B 10/5676 |
| 2023/0417109 | A1* | 12/2023 | Zhang | E21B 10/54 |
| 2024/0110446 | A1* | 4/2024 | Chen | E21B 10/43 |
| 2024/0110447 | A1* | 4/2024 | Chen | E21B 10/43 |
| 2024/0110448 | A1* | 4/2024 | Chen | E21B 10/5673 |

* cited by examiner

CUTTING ELEMENT INCLUDING TWO OR MORE SHAPED CUTTING FEATURES, EACH HAVING A CONVEX AND INWARDLY/DOWNWARDLY ANGLED SHAPE

CROSS-REFERENCE TO RELATED APPLICATION

This application claims the benefit of U.S. Provisional Application Ser. No. 63/604,961, filed on Dec. 1, 2023, entitled "CUTTING ELEMENT INCLUDING TWO OR MORE SHAPED CUTTING FEATURES WITH BOTH A CONVEX PORTION AND A CONCAVE PORTION," commonly assigned with this application and incorporated herein by reference in its entirety.

BACKGROUND

Various types of tools are used to form wellbores in subterranean formations for recovering hydrocarbons, such as oil and gas lying beneath the surface. Examples of such tools include rotary drill bits, hole openers, reamers, and coring bits. One common type of drill bit used to drill wellbores is known as a "fixed cutter" or "drag" bit. Rotary drill bits include fixed cutter drill bits, such as polycrystalline diamond ("PDC") cutters.

In conventional wellbore drilling, a drill bit is mounted on the end of a drill string, which may be several miles long. In practice, at the surface of the wellbore, a rotary table or top drive may turn the drill string, including the drill bit arranged at the bottom of the hole to increasingly penetrate the subterranean formation, while drilling fluid is pumped through the drill string. As the drill bit operates and comes into contact with the ground formation, material cut by the drill bit (generally referred to as cuttings, formation cuttings, or chips) is removed from the face of the drill bit and sent up the wellbore via the drilling fluid.

On occasion, however, cuttings may become clogged in the system, which may result in partial or full blockage of hydraulic operations. It follows that blockage may lead to delays in drilling operations, while remedial measures are undertaken to remove the blockage. Such delays are often costly, time consuming, and hamper the efficiency of drilling operations.

BRIEF DESCRIPTION

Reference is now made to the following descriptions taken in conjunction with the accompanying drawings, in which.

DETAILED DESCRIPTION

Figure 1:
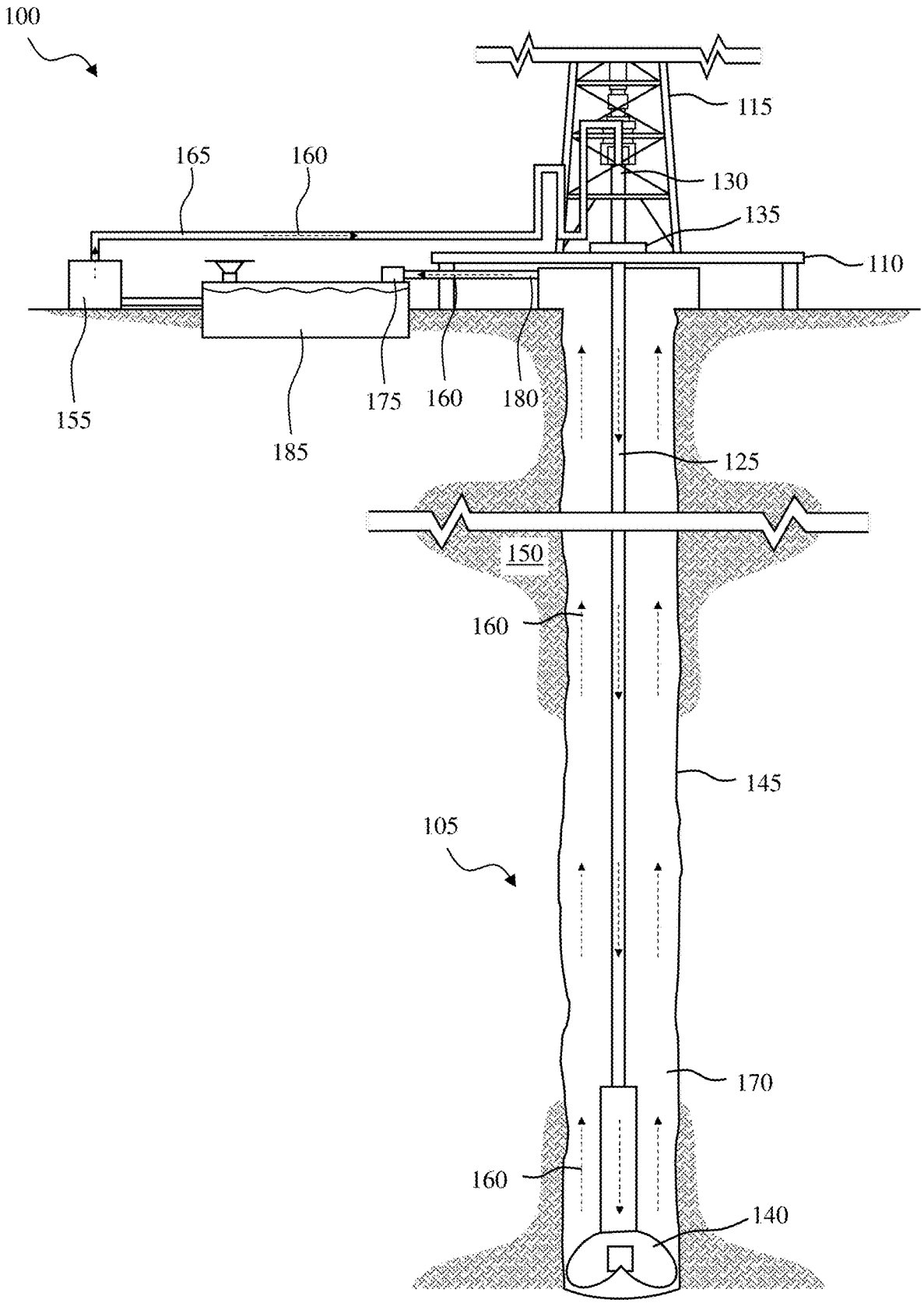
FIG. 1 illustrates a side elevation, partial cross sectional view of a well system including a drilling assembly designed, manufactured and/or operated in accordance with one or more embodiments of the disclosure.

In the drawings and descriptions that follow, like parts are typically marked throughout the specification and drawings with the same reference numerals, respectively. The drawn figures are not necessarily, but may be, to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results. Moreover, all statements herein reciting principles and aspects of the disclosure, as well as specific examples thereof, are intended to encompass equivalents thereof. Additionally, the term, "or," as used herein, refers to a non-exclusive or, unless otherwise indicated.

Unless otherwise specified, use of the terms "connect," "engage," "couple," "attach," or any other like term describing an interaction between elements is not meant to limit the interaction to a direct interaction between the elements and may also include an indirect interaction between the elements described.

Unless otherwise specified, use of the terms "up," "upper," "upward," "uphole," "upstream," or other like terms shall be construed as generally away from the bottom, terminal end of a well, regardless of the wellbore orientation; likewise, use of the terms "down," "lower," "downward," "downhole," "downstream," or other like terms shall be construed as generally toward the bottom, terminal end of a well, regardless of the wellbore orientation. Use of any one or more of the foregoing terms shall not be construed as denoting positions along a perfectly vertical or horizontal axis. Unless otherwise specified, use of the term "subterranean formation" shall be construed as encompassing both areas below exposed earth and areas below earth covered by water, such as ocean or fresh water.

Various values and/or ranges may be explicitly disclosed in certain embodiments herein. However, values/ranges from any lower limit may be combined with any upper limit to recite a range not explicitly recited. Similarly, values/ranges from any lower limit may be combined with any other lower limit to recite a range not explicitly recited. In the same way, values/ranges from any upper limit may be combined with any other upper limit to recite a range not explicitly recited. Additionally, whenever a numerical range with a lower limit and an upper limit is disclosed, any number and any included range falling within the numerical range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited. Similarly, an individual value disclosed herein may be combined with another individual value or range disclosed herein to form another range.

The present disclosure is based, at least in part, on the acknowledgment that current available shaped cutters (e.g., 3D shaped PDC cutters) have either two basic surfaces: either a convex surface for medium to hard formation cutting, or a concave surface for soft to medium formation cutting. Unfortunately, a shaped cutter may need to cut into various different rock types regardless of the style of cutter being used.

Provided are systems and methods for wellbore drilling and, more particularly, example embodiments may use one or more cutting elements that can accommodate these varying different rock types. In at least one embodiment, each cutting element includes a cutting face having one or more specifically shaped cutting features extending therefrom, for example including both a convex portion and a concave portion. In at least one other embodiment, each cutting element includes a cutting face having two or more specifically shaped cutting features extending therefrom, for example including both a convex portion and a concave portion. In at least one embodiment, each of the two or more shaped cutting features is convex shaped, but also angles inwardly and downwardly from a radial exterior point of the cutting feature to a radial interior point of the cutting feature. In at least one embodiment, the radial interior point of each cutting feature is a radial CenterPoint ($C_P$) of the cutting element. In at least one embodiment, the cutting face includes at least three of the disclosed shaped cutting features. In at least one other embodiment, the cutting face includes at least four of the disclosed shaped cutting features.

In at least one embodiment, each of the two or more shaped cutting features are substantially smooth (e.g., but for surface imperfections) from the radial exterior point to the radial interior point. Further to the present disclosure, each of the two or more shaped cutting features may have one or more teeth extending at least partially (e.g., or fully) from the radial exterior point to the radial interior point. For example, in at least one embodiment, the two or more shaped cutting features may have three or more teeth extending from the radial exterior point to the radial interior point. In at least one embodiment, the one or more teeth are one or more rounded teeth, and in yet another embodiment the one or more teeth are one or more sharp teeth.

FIG. 1 illustrates a side elevation, partial cross sectional view of a well system 100 including a drilling assembly 105 designed, manufactured and/or operated in accordance with one or more embodiments of the disclosure. It should be noted that while FIG. 1 generally depicts a land-based drilling assembly 105, those skilled in the art will readily recognize that the principles described herein are equally applicable to subsea drilling operations that employ floating or sea-based platforms and rigs without departing from the scope of the disclosure. As illustrated, the drilling assembly 105 may include a drilling platform 110 that supports a derrick 115 having a traveling block (not shown) for raising and lowering a drill string 125. The drill string 125 may include, but is not limited to, drill pipe and/or coiled tubing, as generally known to those skilled in the art. A kelly 130 supports the drill string 125 as it is lowered through a rotary table 135. A drill bit 140 is attached to the distal end of the drill string 125 and is driven either by a downhole motor and/or via rotation of the drill string 125 from the well surface, among other methods. As the drill bit 140 rotates, it creates a wellbore 145 that penetrates one or more subterranean formations 150.

The drill bit 140 may be a fixed-cutter bit. However, the drill bit 140 may comprise any suitable drill bit (e.g., a roller cone bit, a hybrid bit, etc.) and remain within the scope of the disclosure. The drill bit 140 may employ one or more cutting elements (e.g., as shown in FIGS. 3A through 6). As set forth in greater detail below, the cutting elements may include one or more features that facilitate a flow of cuttings and other drilling debris away therefrom. Further, while a drill bit 140 is shown, the drilling assembly may additionally be used to operate hole openers, reamers, and coring bits.

A pump 155 (e.g., a mud pump) may be used to circulate drilling fluid 160 through a feed pipe 165 and to the kelly 130, which conveys the drilling fluid 160 downhole through the interior of the drill string 125 and through one or more orifices in the drill bit 140. The drilling fluid 160 may then be circulated back to the surface via an annulus 170 defined between the drill string 125 and the walls of the wellbore 145. At the surface, the recirculated or spent drilling fluid 160 exits the annulus 170 and may be conveyed to one or more fluid processing unit(s) 175 via an interconnecting flow line 180. After passing through the fluid processing unit(s) 175, "cleaned" drilling fluid 160 is deposited into a nearby retention pit 185 (e.g., a mud pit). While illustrated as being arranged at the outlet of the wellbore 145 via the annulus 170, those skilled in the art will readily appreciate that the fluid processing unit(s) 175 may be arranged at any other location in the drilling assembly 105 to facilitate its proper function, without departing from the scope of the disclosure.

It is also to be recognized that the drilling fluid 160 may also directly or indirectly affect the various downhole equipment and tools that it may come into contact during operation. Such equipment and tools may include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like. Any of these components, among others, may be included in the systems generally described above and depicted in FIG. 1.

Figure 2:
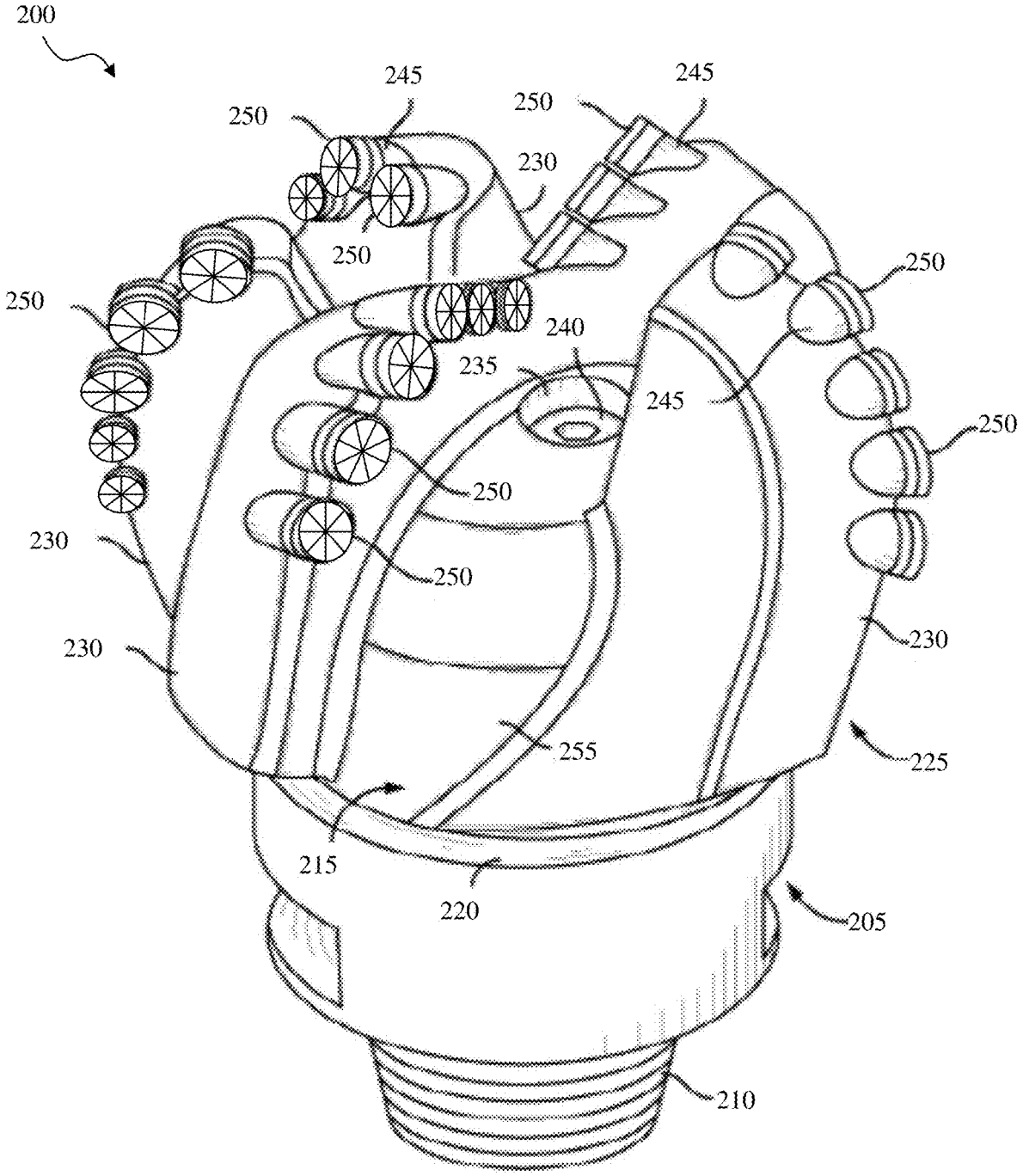
FIG. 2 illustrates a perspective view of a drill bit (e.g., fixed-cutter drill bit) designed, manufactured and/or operated according to one or more embodiments of the disclosure, as could be used with the well system of FIG. 1, and having one or more cutting elements, in accordance with some embodiments of the present disclosure.

FIG. 2 illustrates a perspective view of a drill bit 200 (e.g., fixed-cutter drill bit) designed, manufactured and/or operated according to one or more embodiments of the disclosure, as could be used with the well system 100 of FIG. 1, and having one or more cutting elements 250 designed, manufactured and/or placed in accordance with some embodiments of the present disclosure. The drill bit 200 may have a bit body 225. In some embodiments, the bit body 225 may be formed by steel, a metal-matrix composite (e.g., tungsten carbide reinforcing particles dispersed in a binder alloy), or another acceptable material. As used herein, the term "drill bit" encompasses rotary drag bits, drag bits, fixed-cutter drill bits, and any other drill bit having a bit body and capable of incorporating the teachings of the present disclosure. A plurality of indentations or pockets 245 may be formed in the bit body 225 and are shaped or otherwise configured to receive corresponding cutting elements 250 as described herein. As illustrated, the bit body 225 includes a plurality of the cutting elements 250. The one or more of the cutting elements 250 may be the same as or similar to the cutting element 300 of FIGS. 3A through 3F, cutting element 400 of FIGS. 4A through 4D, cutting element 500 of FIG. 5, and cutting element 600 of FIG. 6, among others. It will be appreciated that cutting elements 250 may be comprised of any number of suitable materials, including a PDC composition.

Moreover, the drill bit 200 may include a metal shank 205 with a mandrel or metal blank 215 securely attached thereto (e.g., at weld location 220). The metal blank 215 extends into bit body 225. The metal shank 205, in certain embodiments, includes a threaded connection 210 distal to the metal blank 215. The bit body 225 may include a plurality of cutter blades 230 formed on the exterior of the bit body 225. Further, the cutter blades 230 may be spaced from each other on the exterior of the bit body 225 to form fluid flow paths or junk slots 255 therebetween.

As illustrated, the plurality of pockets 245 may be formed in the cutter blades 230 in predetermined positions. The cutting elements 250 may each be securely mounted (e.g., via brazing) in corresponding pockets 245 to engage and remove portions of a subterranean formation during drilling operations. That is, each cutting element 250 may be configured to scrape and gouge formation materials from the bottom and sides of a wellbore during rotation of the drill bit 200 by an attached drill string.

A nozzle 240 may be positioned in each nozzle opening 235 and positioned to clear cuttings/chips of formation material from cutting elements 250 through evacuation features of the drill bit 200, including junk slots 255. The bit body 225 may further include the plurality of cutter blades 230 that are separated by the junk slots 255. As the drill bit 200 operates and comes into contact with the ground formation, cuttings are removed from the face of the drill bit 200 and sent up the wellbore via drilling fluid. However, as set forth above, cuttings may generally become clogged in the system, which may result in partial or full blockage of hydraulic operations.

Accordingly, during drilling operations, cuttings may be directed toward higher fluid velocities, via the plurality of cutting elements, to accelerate cuttings removal. Generally, the center of the drill bit 200 may experience low fluid velocities which may cause poor cutting removal. Accordingly, each cutting element 250 may include one or more features that facilitate cutting removal by directing cuttings toward the annulus of the wellbore. In particular, each cutting element 250 may include one or more relief surfaces that are asymmetric (e.g., as discussed herein).

Turning now to FIGS. 3A through 3G, illustrated are various different views of a cutting element 300 designed, manufactured and/or operated according to one or more embodiments of the disclosure. The cutting element 300, in one or more embodiments, includes a base section 310 (e.g., a carbide base section), and a cutting section 320 (e.g., a PDC cutting section) coupled to the base section 310. In one or more embodiments, as shown, the base section 310 includes a base section thickness ($t_b$), and the cutting section 320 includes a cutting section thickness ($t_c$). In at least one embodiment, the base section thickness ($t_b$) ranges from 6.35 mm to 25.4 mm (e.g., from about 0.25 inches to about 1.0 inches), and the cutting section thickness ($t_c$) ranges from 1.9 mm to 8.89 mm (e.g., ranges from about 0.075 inches to about 0.35 inches). Nevertheless, unless otherwise stated, other thicknesses may be used for the base section thickness ($t_b$) and cutting section thickness ($t_c$) without departing from the scope of the present disclosure.

The cutting section 320, in one or more embodiments, includes a cutting face 325. In the illustrated embodiment, the cutting section 320 further includes two or more shaped cutting features 330 extending from the cutting face 325. In at least one embodiment, the two or more shaped cutting features 330 are formed using an ablation process, such as a laser ablation process, from an original diamond table face, thus resulting in the two or more shaped cutting features 330 and the cutting face 325. Nevertheless, the present disclosure is not limited to any specific process, ablation or otherwise, for creating the two or more shaped cutting features 330. In the illustrated embodiment of FIGS. 3A through 3G, four shaped cutting features 330 extend from the cutting face 325. Nevertheless, other embodiments may exist wherein from two to twelve shaped cutting features 330 (e.g., 2 or more, 3 or more, 4 or more, 5 or more, 6 or more, 7 or more, 8 or more, 9 or more, 10 or more, 11 or more, 12 or more, 13 or more, 14 or more, 15 or more, 16 or more, 17 or more, 18 or more, 19 or more, 20 or more, etc.), or more, are employed for a single cutting section 320.

Each of the two or more shaped cutting features 330, in at least one embodiment, is convex shaped, but also angles inwardly and downwardly from a radial exterior point of the cutting feature 330 to a radial interior point of the cutting feature 330. Accordingly, in at least one embodiment a thickness of the two or more shaped cutting features 330 near the radial exterior point is greater than a thickness of the two or more shaped cutting features 330 near the radial interior point. It should be noted that the convexity of the two or more shaped cutting features 330 need not be a true curved surface, but may also be V-shaped as well, and thus include one or more ridges proximate a center thereof.

Figure 3A:
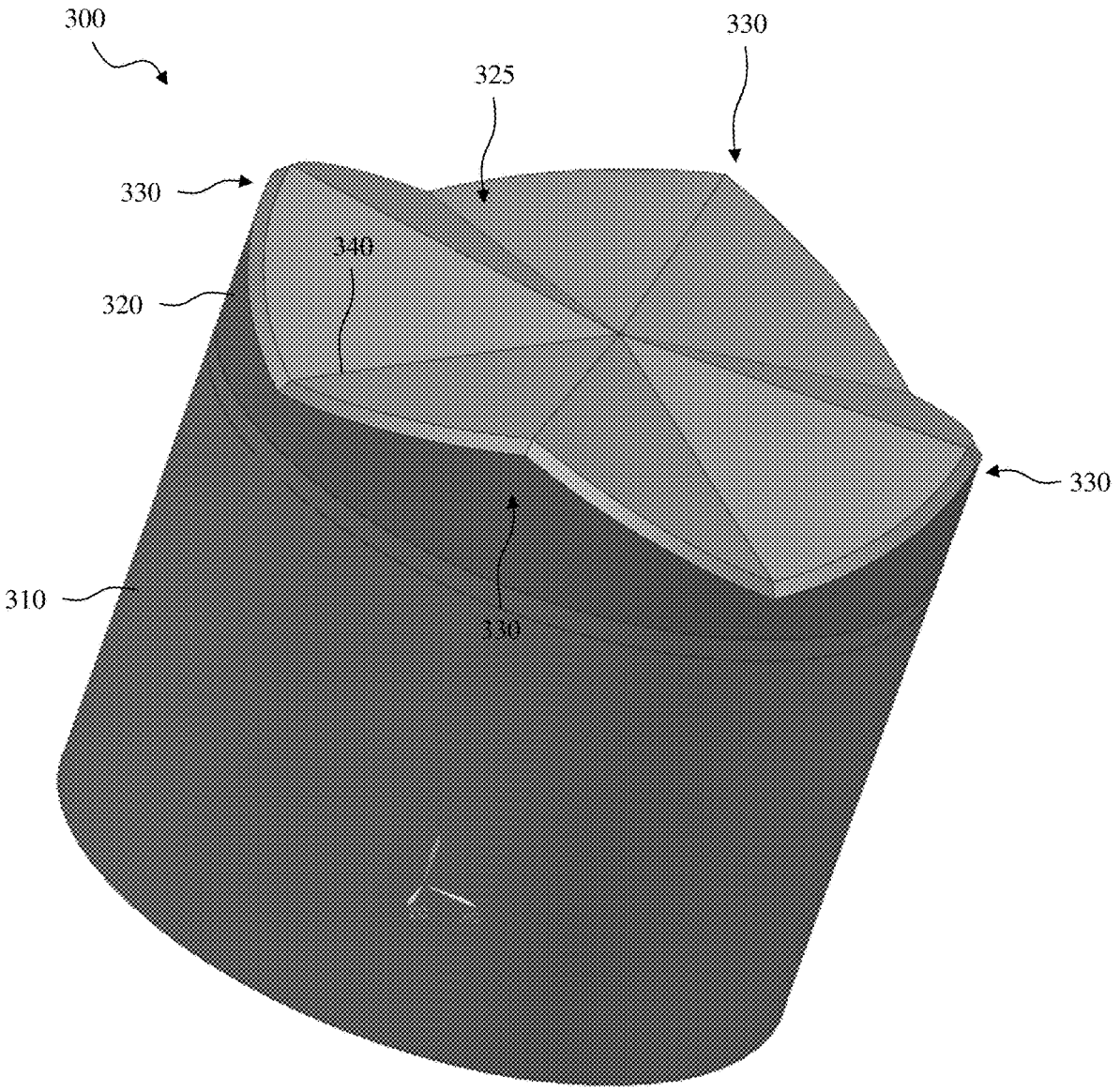
FIGS. 3A through 3G illustrate various different views of a cutting element designed, manufactured and/or operated according to one or more embodiments of the disclosure.
Figure 3B:
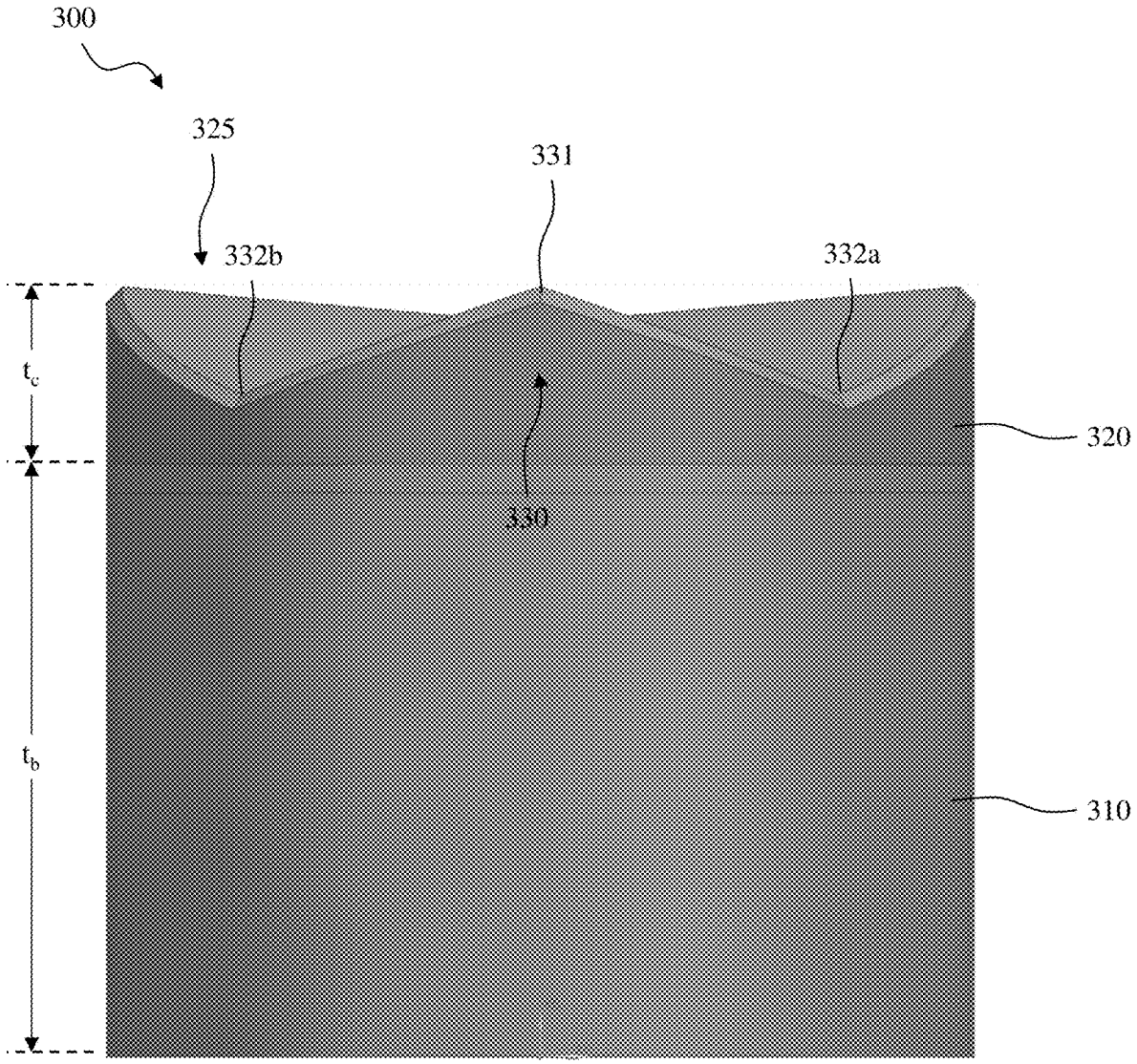
Figure 3C:
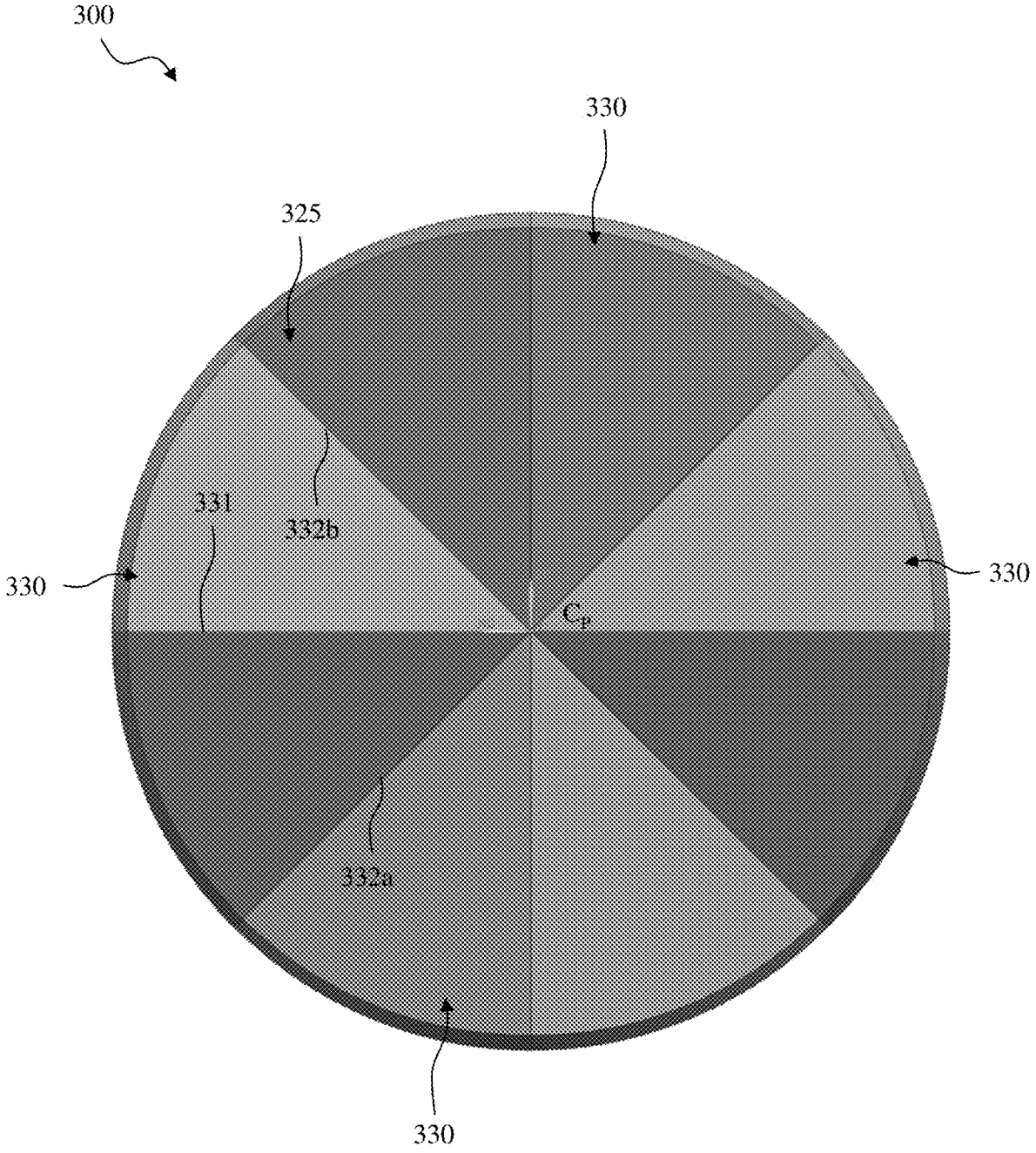
Figure 3D:
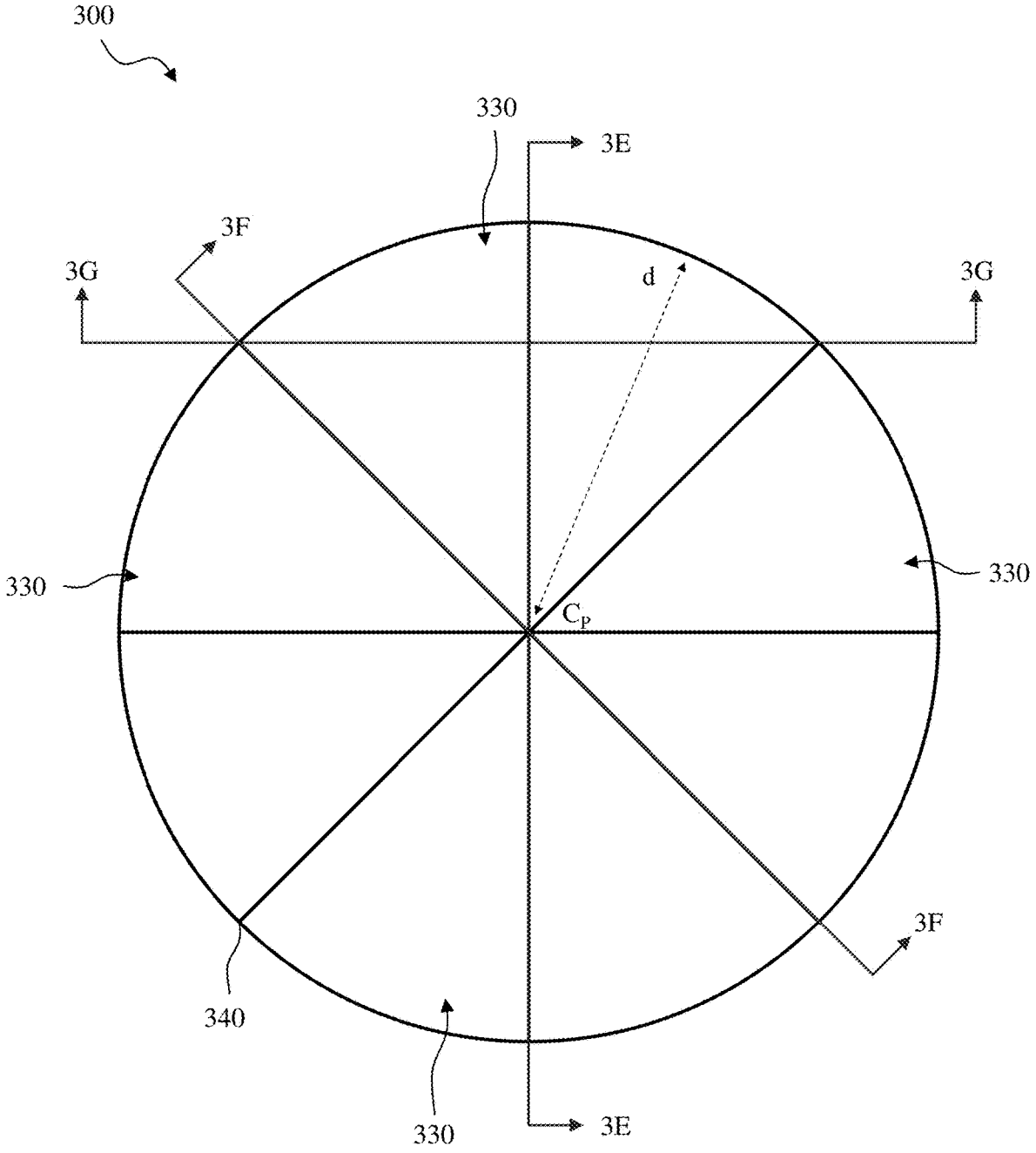
Figure 3E:
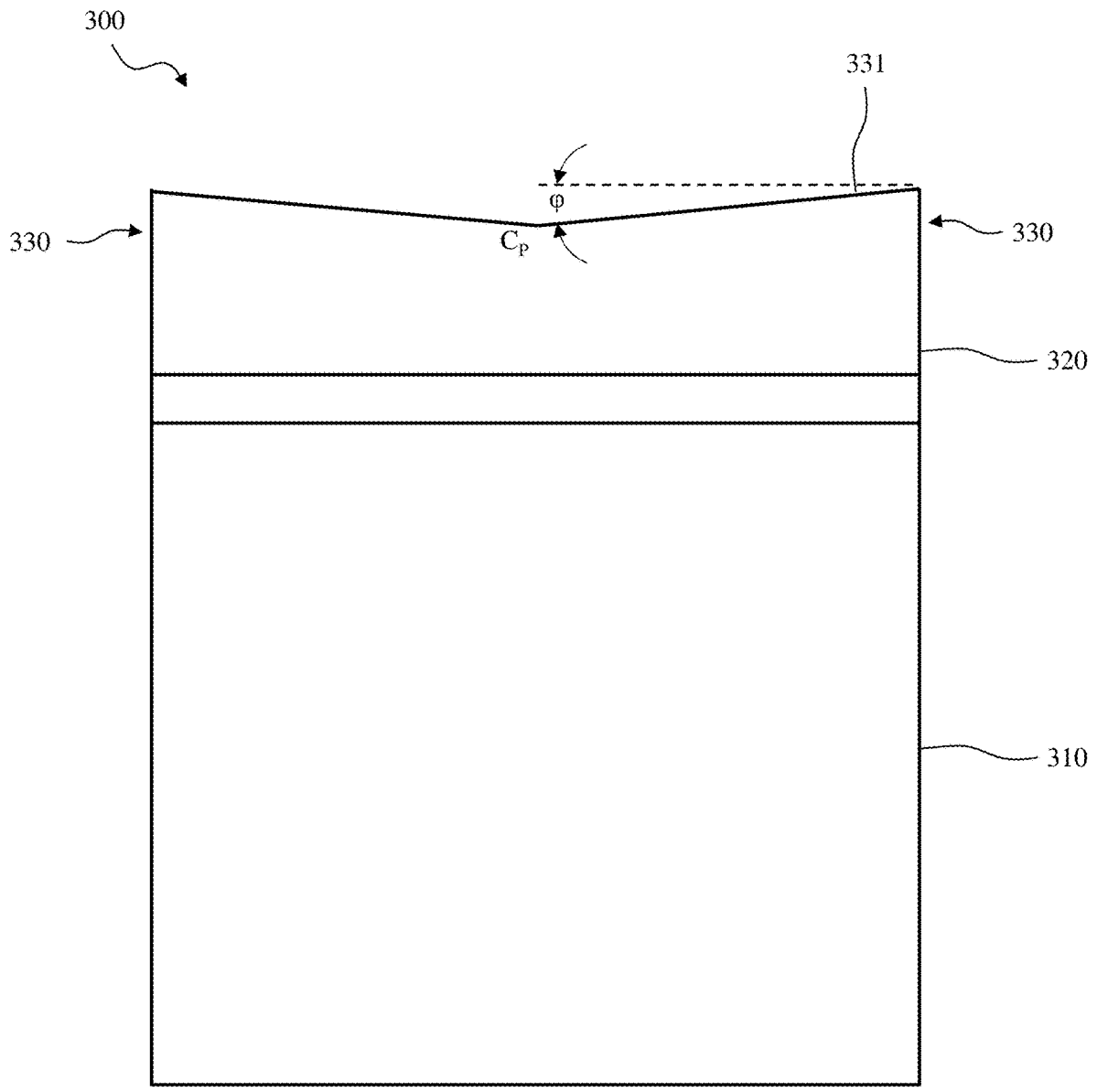
Figure 3F:
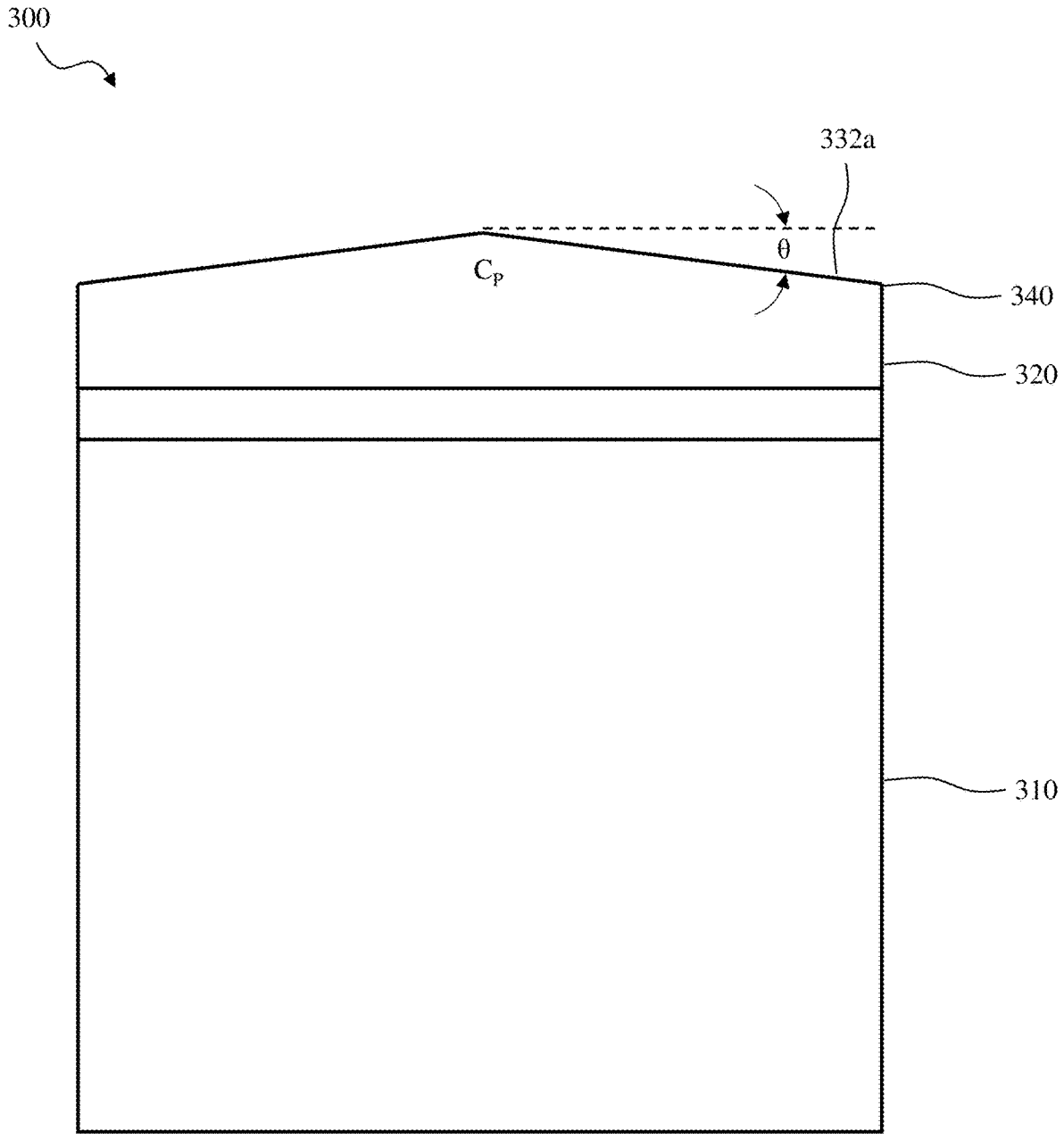
Figure 3G:
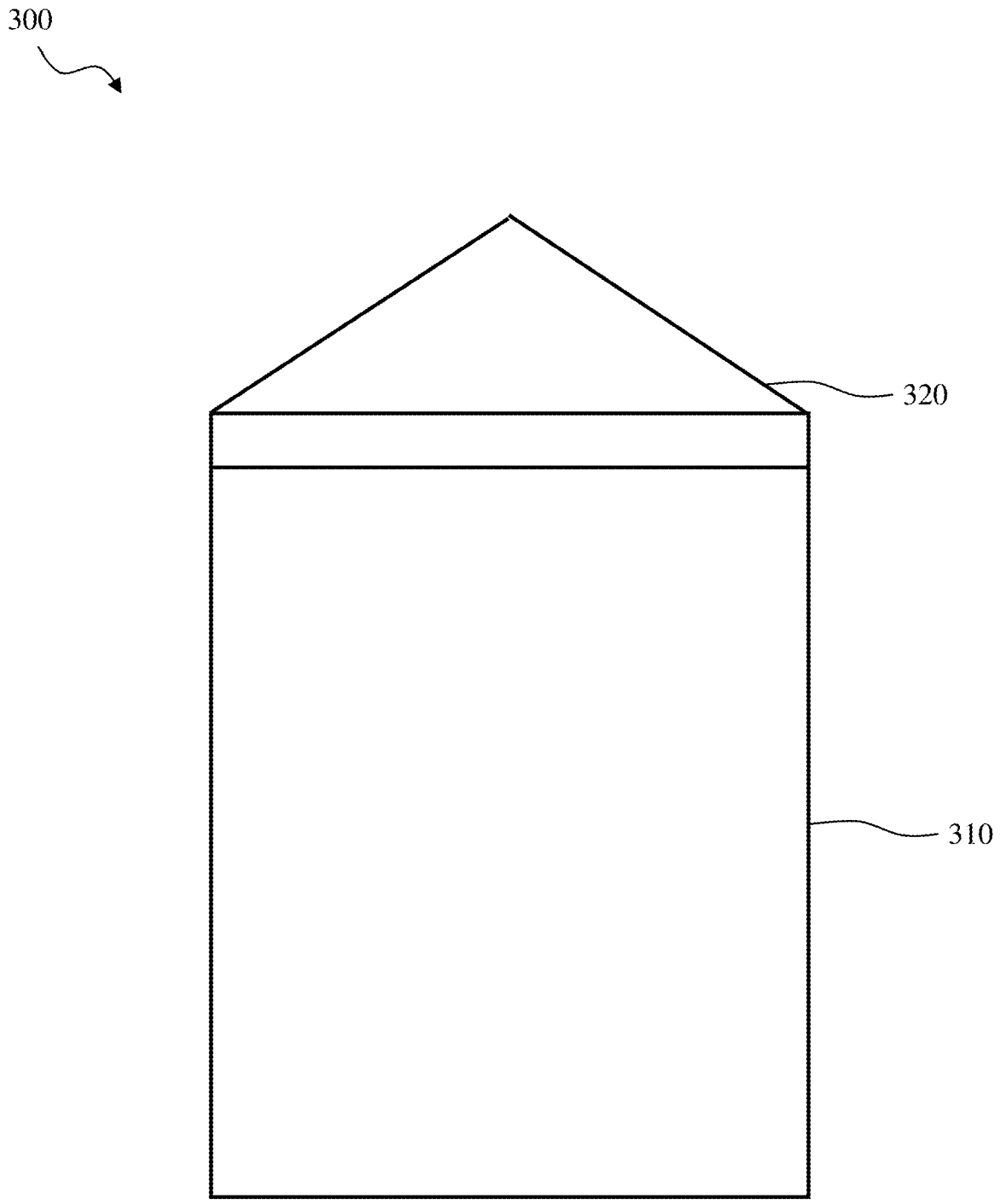

In at least one embodiment, the two or more shaped cutting features 330 each have a peak 331 and two edges 332*a*, 332*b*, the peak angling inwardly and downwardly from the radial exterior point of the cutting feature 330 to a radial interior point thereof at an angle ($\varphi$), which may also be referred to as the internal rake angle, as shown in FIG. 3E. The angle ($\varphi$) may vary greatly and remain within the scope of the disclosure, but in one embodiment may range from 0.5 degrees to 20 degrees, if not from 1 degree to 15 degrees, if not from 5 degrees to 10 degrees. It should also be noted that in one or more embodiments, a point at which the two or more shaped cutting features 330 come together proximate the radial CenterPoint ($C_P$) of the cutting element 300 is a greater distance from the base section 310 than bottom edges 340 of the convexity of the two or more shaped cutting features 330 along the circumference of the cutting element 300. Accordingly, the radial CenterPoint ($C_P$) of the cutting element may angle outward and downward toward the bottom edges 340 of the convexity of the two or more shaped cutting features 330 at an angle (θ), which is equivalent to the two edges 332*a*, 332*b* angling continuously inwardly and upwardly by the angle (θ) from the radial exterior point of its shaped cutting feature to the radial interior point of its shaped cutting feature, as shown in FIG. 3F. The angle (θ) may vary greatly and remain within the scope of the disclosure, but in one embodiment may range from 0.5 degrees to 40 degrees, if not from 1 degree to 15 degrees, if not from 5 degrees to 10 degrees. In at least one embodiment, the radial interior point of each shaped cutting feature 330 is a radial CenterPoint ($C_P$) of the cutting element 300, and thus the two or more shaped cutting features 330 come together proximate the radial CenterPoint ($C_P$) of the cutting element 300. In yet other embodiments, the two or more shaped cutting features 330 come together at the radial CenterPoint ($C_P$) of the cutting element 300.

Figure 4A:
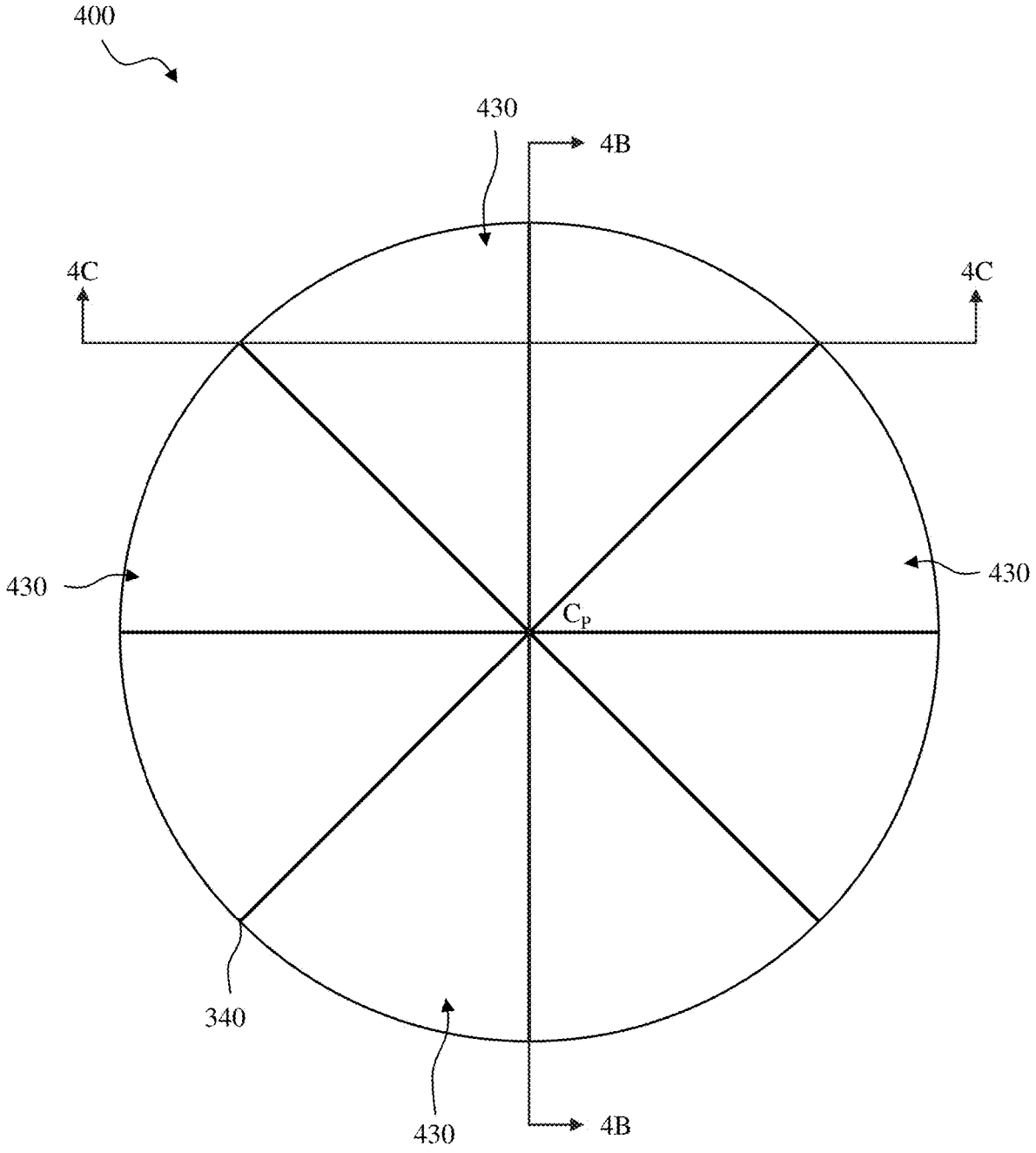
FIGS. 4A through 4C illustrate various different views of a cutting element designed, manufactured and/or operated according to one or more alternative embodiments of the disclosure.
Figure 4B:
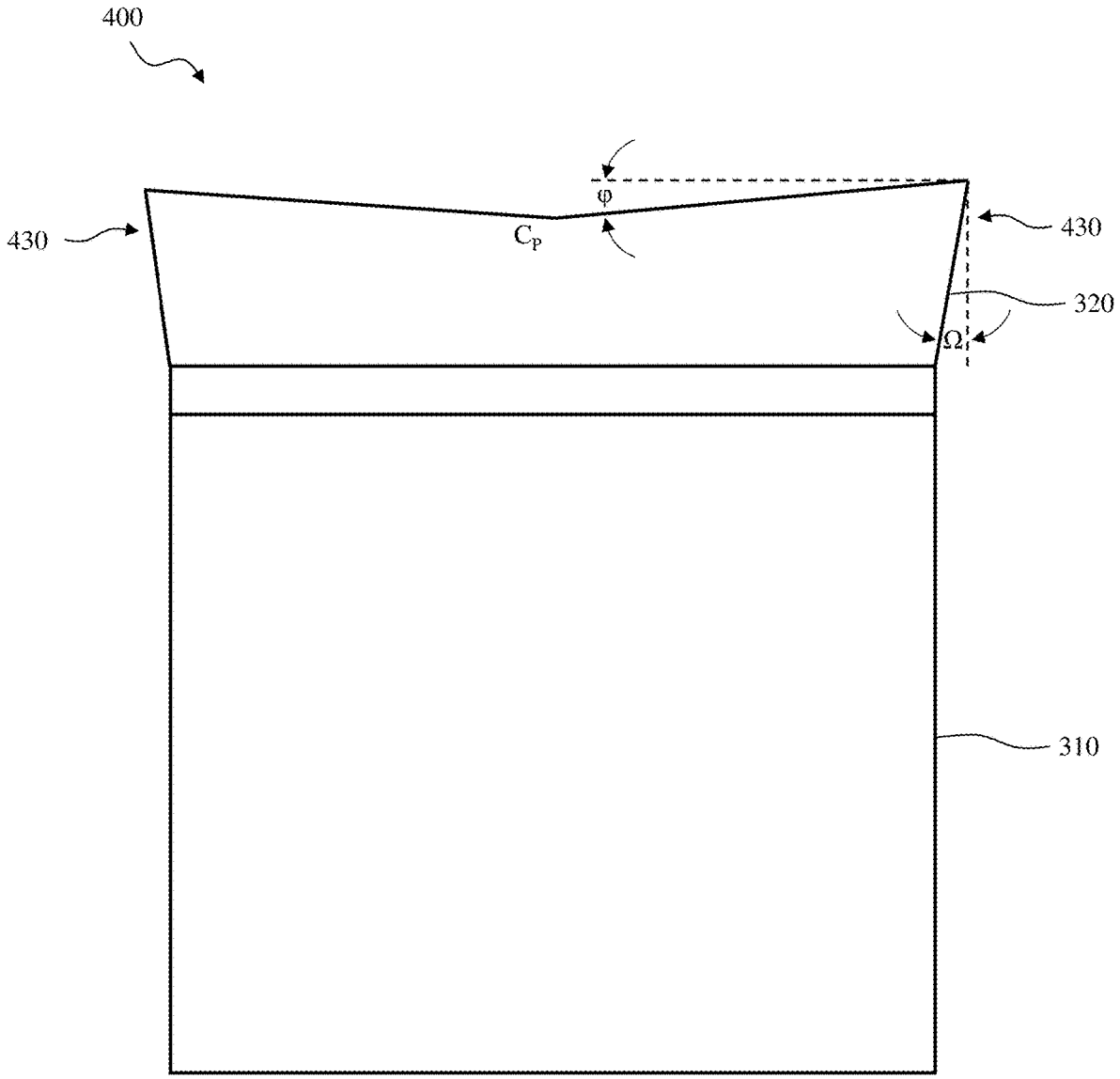
Figure 4C:
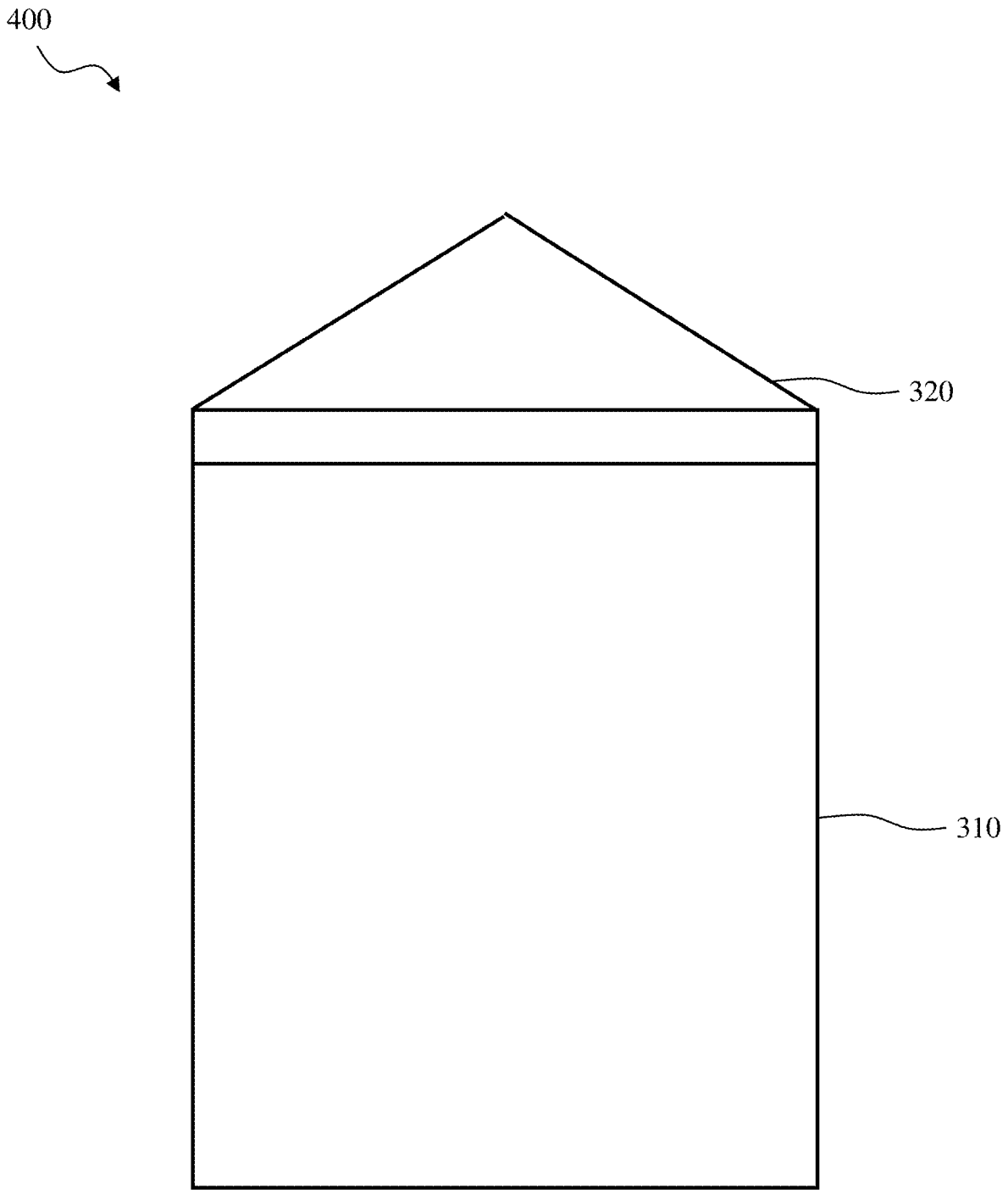
Figure 5A:
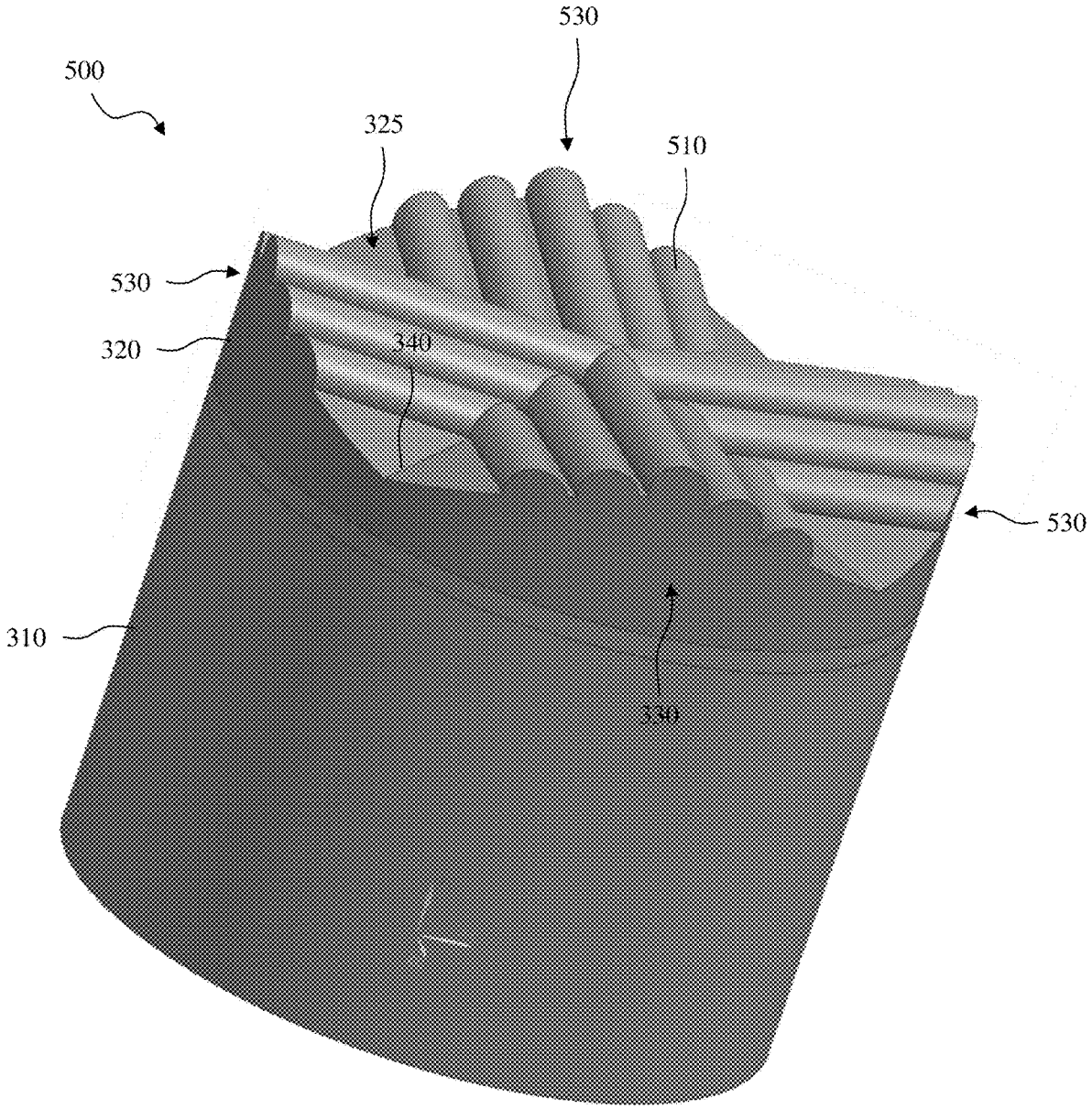
FIGS. 5A through 5F illustrate various different views of a cutting element designed, manufactured and/or operated according to one or more alternative embodiments of the disclosure.
Figure 5B:
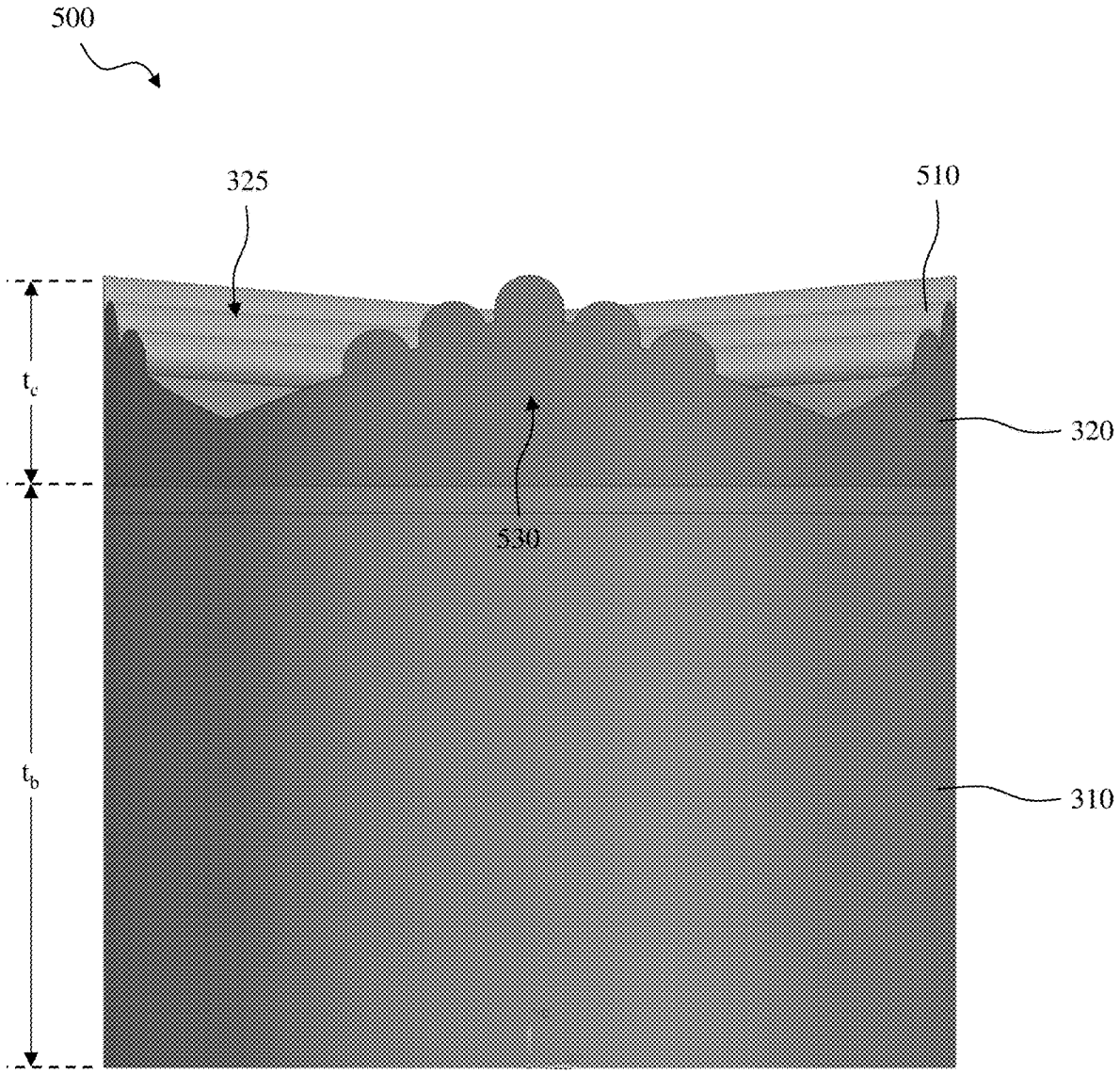
Figure 5C:
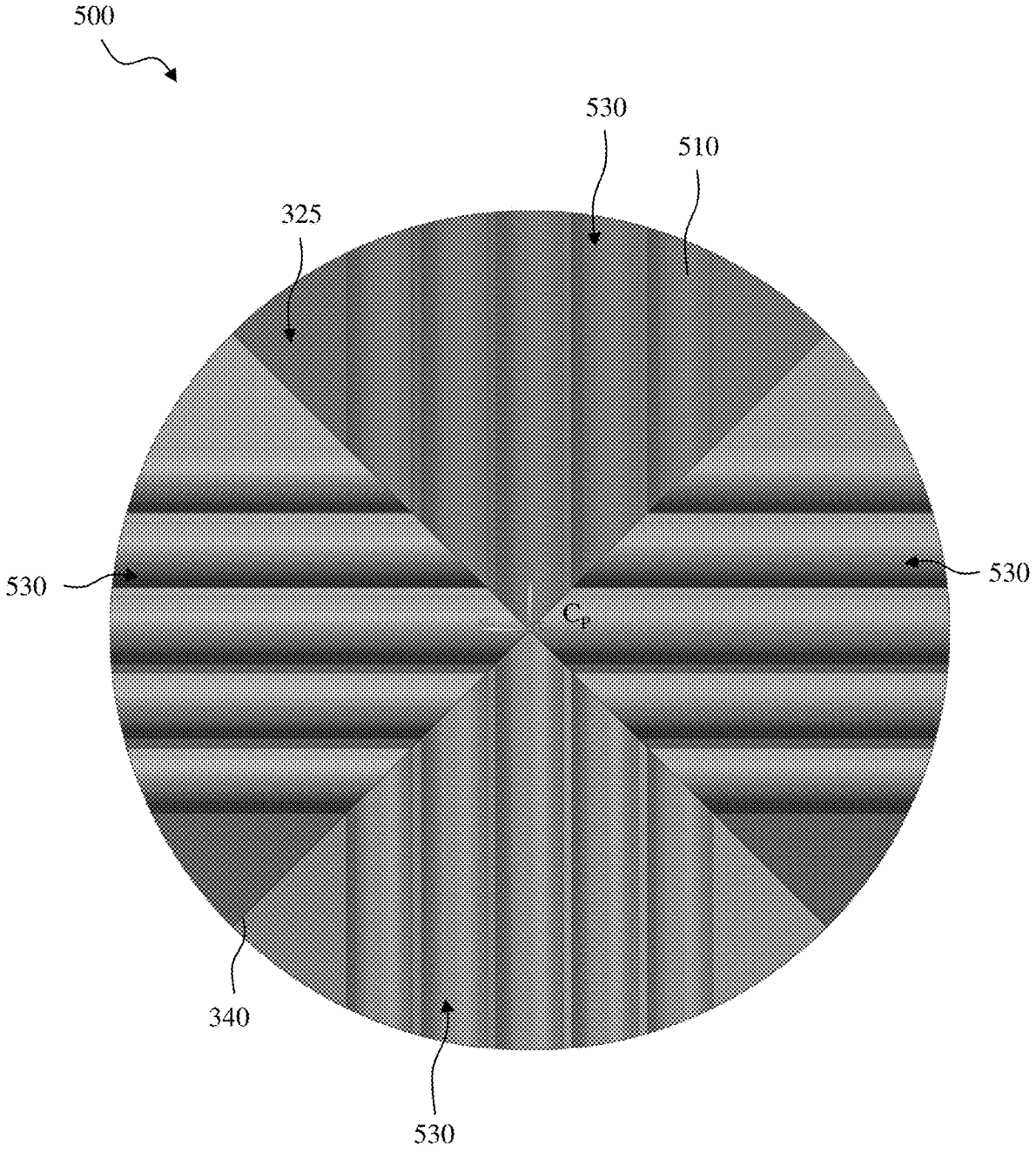
Figure 5D:
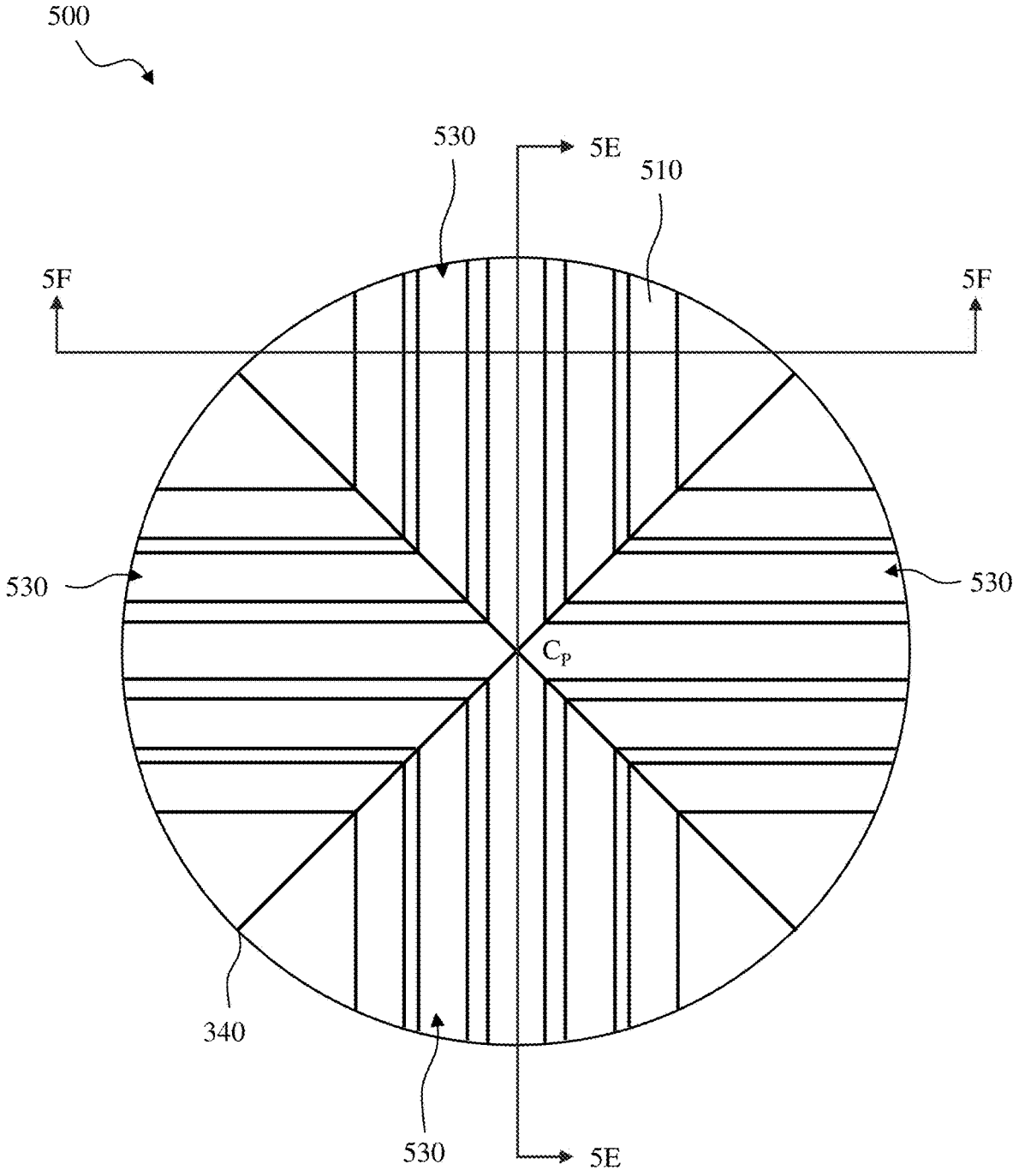
Figure 5E:
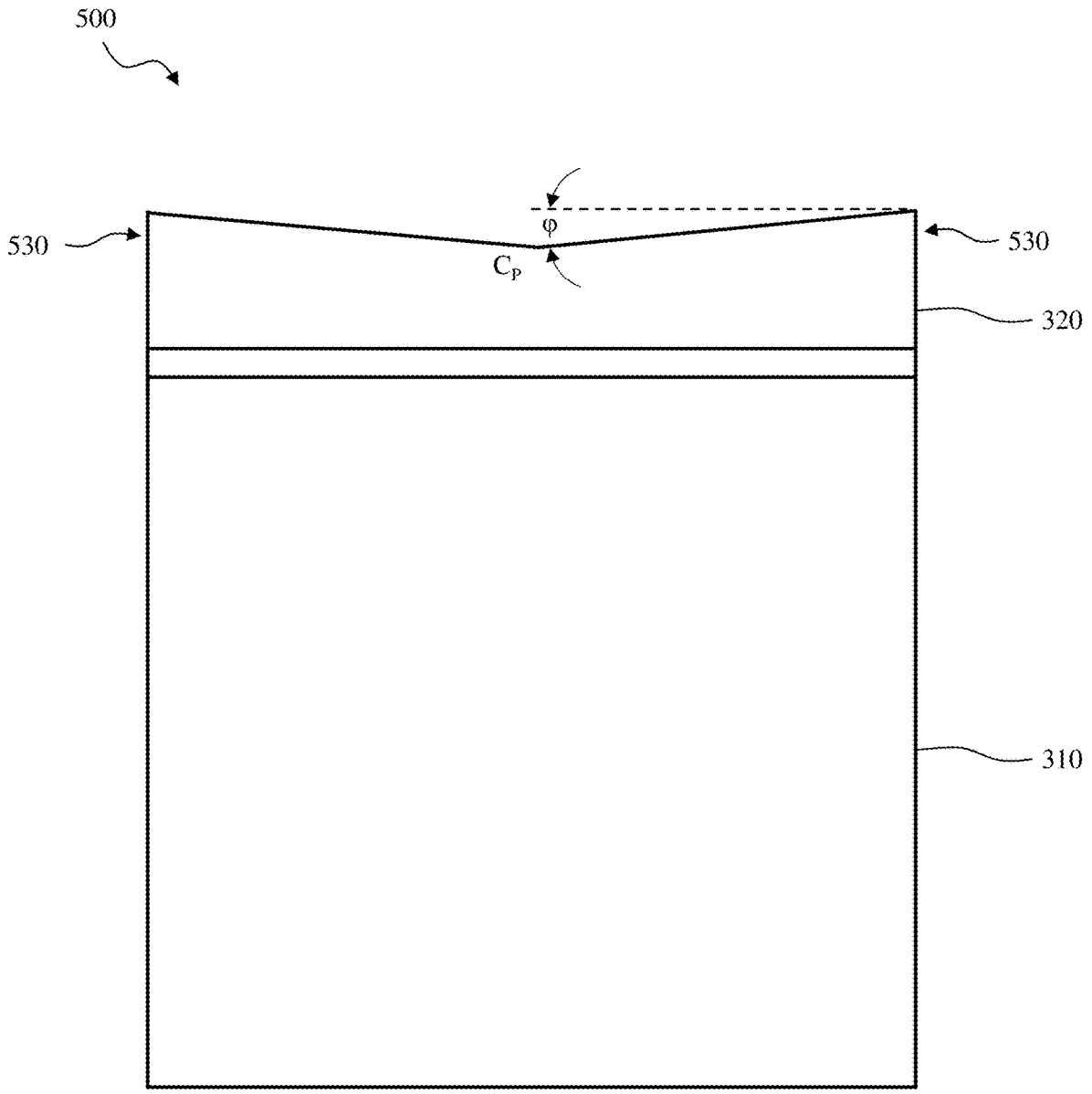
Figure 5F:
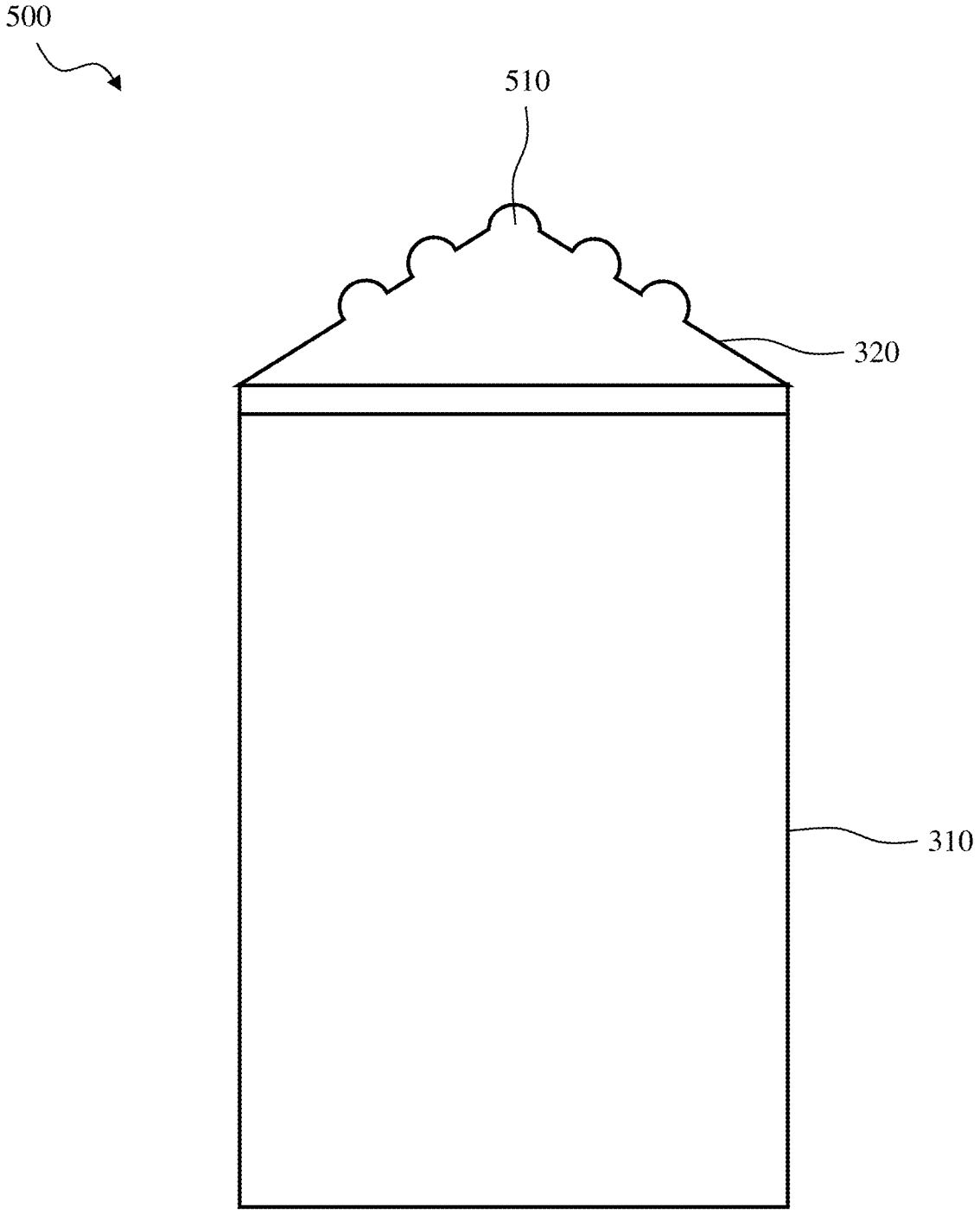

Turning now to FIGS. 4A through 4C, illustrated are various different views of a cutting element 400 designed, manufactured and/or operated according to one or more alternative embodiments of the disclosure. The cutting element 400 of FIGS. 4A through 4C is similar in many respects to the cutting element 300 of FIGS. 3A through 3G. Accordingly, like reference numbers have been used to indicate similar, if not identical, features. The cutting element 400 of FIGS. 4A through 4C differs, for the most part, from the cutting element 300 of FIGS. 3A through 3G, in that the two or more shaped cutting features 430 are angled outward by an angle (Ω). The angle (Ω) may vary greatly and remain within the scope of the disclosure, but in one embodiment may range from 0.5 degrees to 20 degrees, if not from 1 degree to 10 degrees. The cutting element 400 of FIGS. 4A through 4C, in certain embodiments, is better suited for soft to medium formations, as opposed to the cutting element 300 of FIGS. 3A through 3G, which is better suited for harder formations.

Turning now to FIGS. 5A through 5F, illustrated are various different views of a cutting element 500 designed, manufactured and/or operated according to one or more alternative embodiments of the disclosure. The cutting element 500 of FIGS. 5A through 5F is similar in many respects to the cutting element 300 of FIGS. 3A through 3G. Accordingly, like reference numbers have been used to indicate similar, if not identical, features. The cutting element 500 of FIGS. 5A through 5F differs, for the most part, from the cutting element 300 of FIGS. 3A through 3G, in that each of the two or more shaped cutting features 530 has one or more teeth 510 extending at least partially (e.g., or fully) from the radial exterior point to the radial interior point. For example, in at least one embodiment, the two or more shaped cutting features 530 may have three or more teeth 510, four or more teeth 510, or five or more teeth 510 (e.g., as shown), extending from the radial exterior point to the radial interior point. In at least one embodiment, the one or more teeth 510 are one or more rounded teeth, as shown.

Figure 6A:
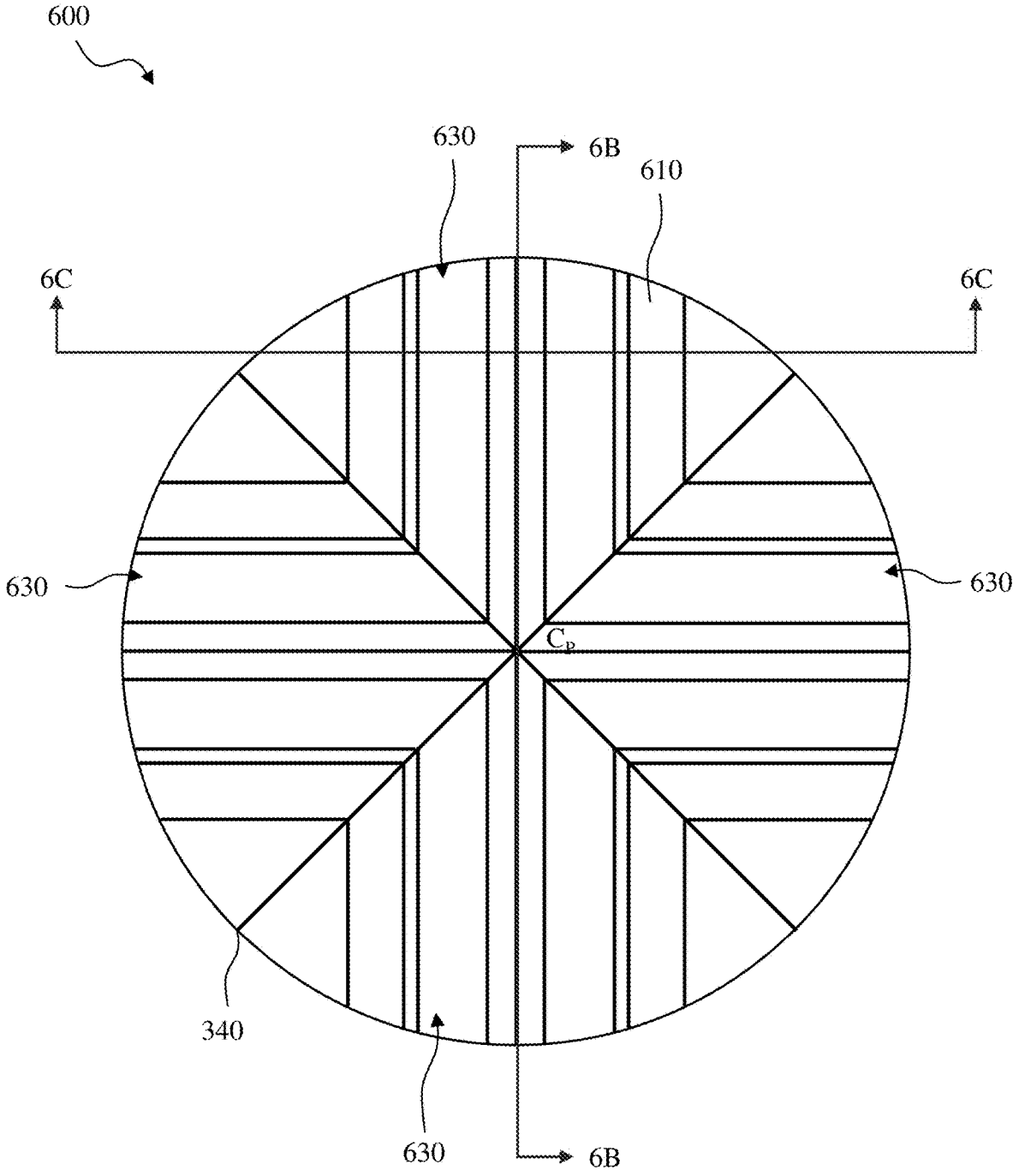
FIGS. 6A through 6C illustrate various different views of a cutting element designed, manufactured and/or operated according to one or more alternative embodiments of the disclosure.
Figure 6B:
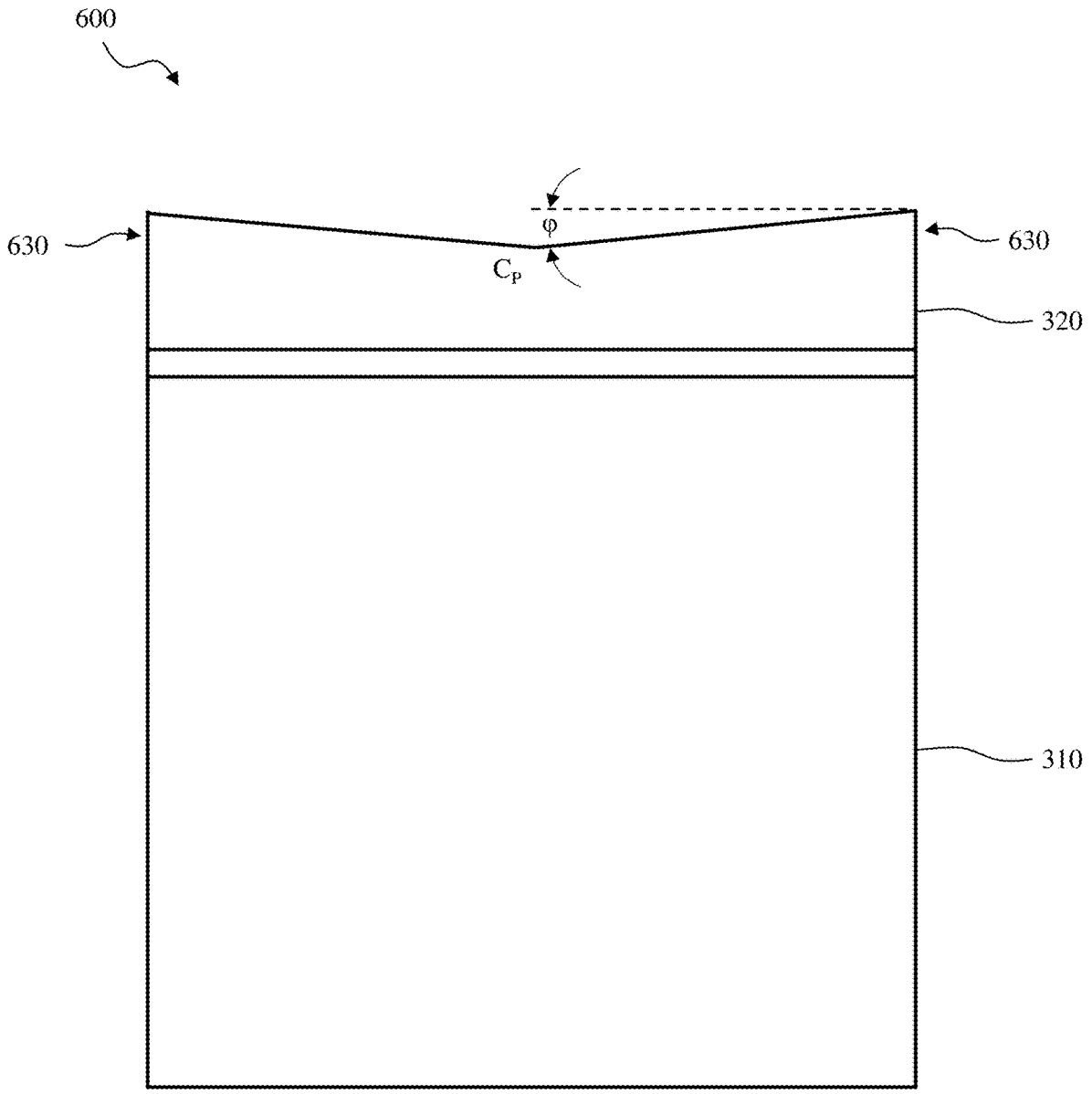
Figure 6C:
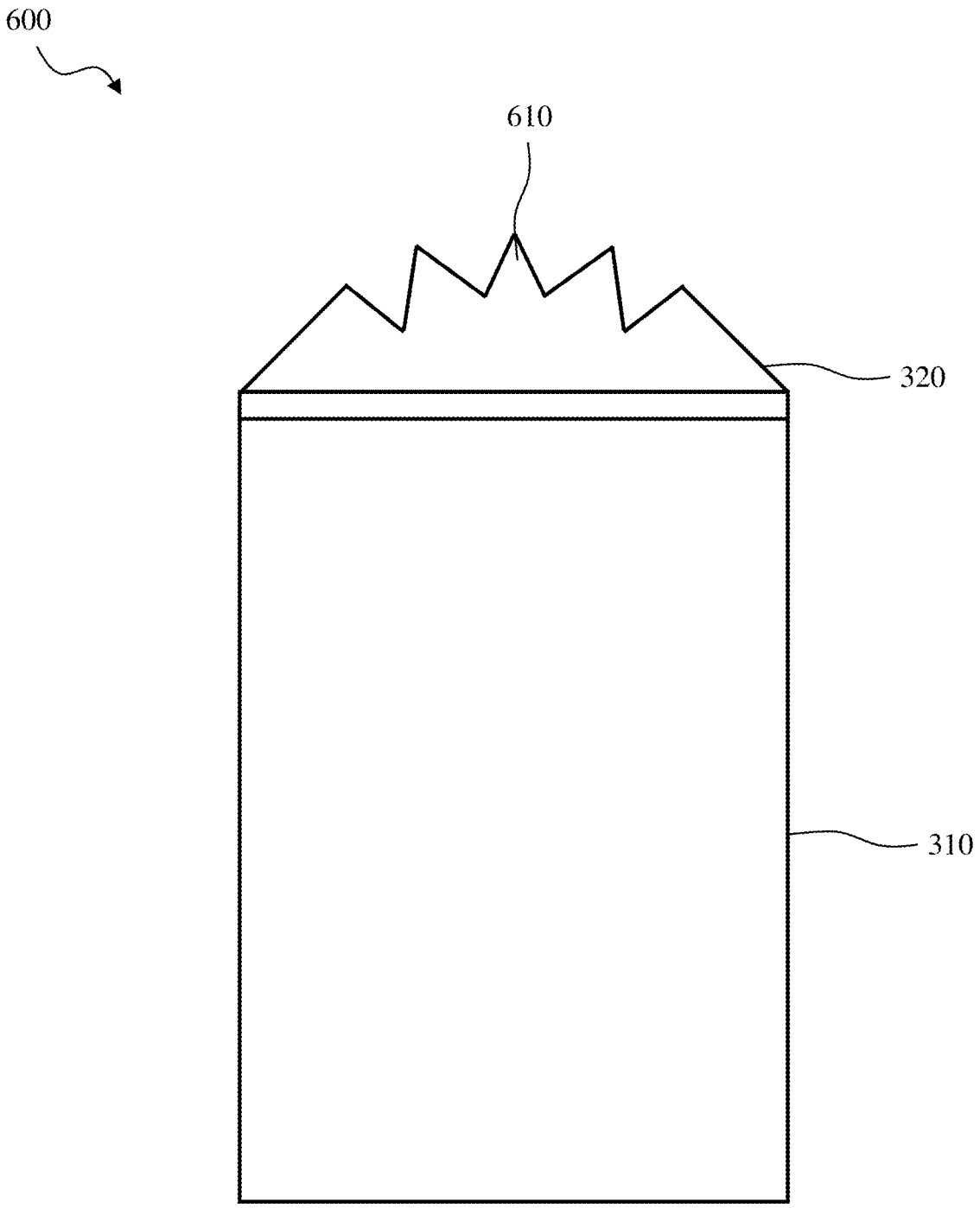

Turning now to FIGS. 6A through 6C, illustrated are various different views of a cutting element 600 designed, manufactured and/or operated according to one or more alternative embodiments of the disclosure. The cutting element 600 of FIGS. 6A through 6C is similar in many respects to the cutting element 500 of FIGS. 5A through 5F. Accordingly, like reference numbers have been used to indicate similar, if not identical, features. The cutting element 600 of FIGS. 6A through 6C differs, for the most part, from the cutting element 500 of FIGS. 5A through 5F, in that each of the two or more shaped cutting features 630 has one or more sharp teeth 610 extending at least partially (e.g., or fully) from the radial exterior point to the radial interior point. For example, in at least one embodiment, the two or more shaped cutting features 630 may have three or more sharp teeth 610, four or more sharp teeth 610, or five or more sharp teeth 610 (e.g., as shown), extending from the radial exterior point to the radial interior point.

Figure 7:
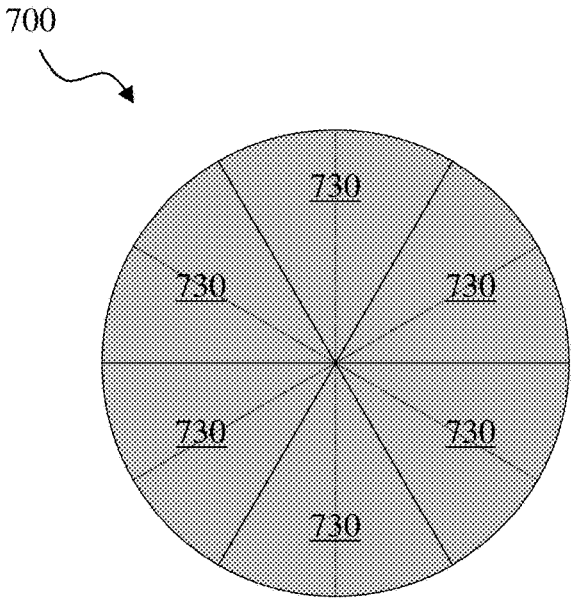
FIGS. 7 through 9 illustrate various different views of a different cutting elements designed, manufactured and/or operated according to one or more alternative embodiments of the disclosure including six or more shaped cutting features, eight or more shaped cutting features, ten or more shaped cutting features, respectively.
Figure 8:
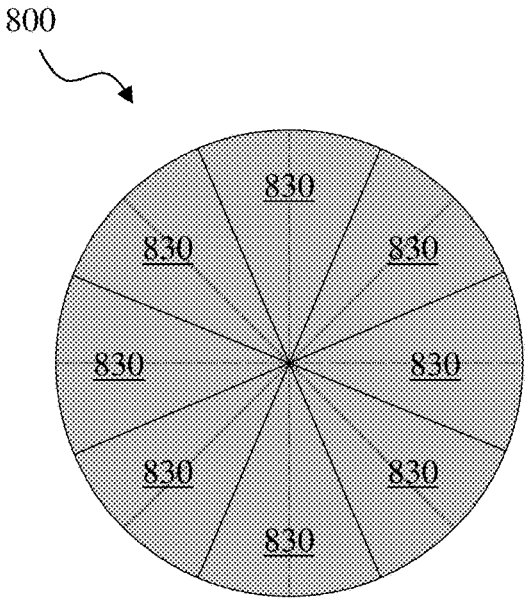
Figure 9:
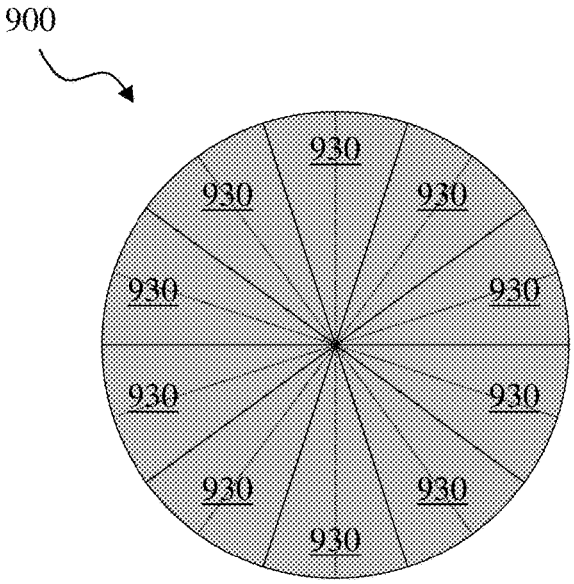

FIGS. 7 through 9 illustrate various different views of a different cutting elements 700, 800, 900 designed, manufactured and/or operated according to one or more alternative embodiments of the disclosure including six or more shaped cutting features 730, eight or more shaped cutting features 830, ten or more shaped cutting features 930, respectively.

Beyond those embodiments disclosed above, the present disclosure is directed to a cutting element with multiple (e.g., more than one) point loading regions spaced (e.g., equally spaced) around a circumference of the cutting face. In at least one embodiment, the point loading regions attach to surfaces that extend away from the circumference as ridges in a mostly 'V' shape (or plow shape). In such an embodiment, each half of the V extends to the adjacent point loading region. The ridges connecting the point loading regions are raised off the flat surface of the cutting face, and in most embodiments curved. This curved ridge thus acts as a chip breaker.

Aspects disclosed herein include:

A. A cutting element, the cutting element including: 1) a cutting section, the cutting section including a cutting section thickness ($t_c$) and a cutting face; and 2) two or more shaped cutting features extending from the cutting face, wherein each of the two or more shaped cutting features is convex shaped, but also angles inwardly and downwardly from a radial exterior point of its shaped cutting feature to a radial interior point of its shaped cutting feature.

B. A drill bit, the drill bit including: 1) a bit body; 2) one or more blades attached to the bit body; 3) one or more pockets formed in the one or more blades; and 4) one or more cutting elements fixed in the one or more pockets, wherein each cutting element includes: a) a cutting section, the cutting section including a cutting section thickness ($t_c$) and a cutting face; and b) two or more shaped cutting features extending from the cutting face, wherein each of the two or more shaped cutting features is convex shaped, but also angles inwardly and downwardly from a radial exterior point of its shaped cutting feature to a radial interior point of its shaped cutting feature.

C. A well system, the well system including: 1) a wellbore formed through one or more subterranean formations; and 2) a drill bit located in the wellbore, the drill bit including: a) a bit body; b) one or more blades attached to the bit body; c) one or more pockets formed in the one or more blades; and d) one or more cutting elements fixed in the one or more pockets, wherein each cutting element includes: i) a cutting section, the cutting section including a cutting section thickness ($t_c$) and a cutting face; and ii) two or more shaped cutting features extending from the cutting face, wherein each of the two or more shaped cutting features is convex shaped, but also angles inwardly and downwardly from a radial exterior point of its shaped cutting feature to a radial interior point of its shaped cutting feature.

Aspects A, B, and C may have one or more of the following additional elements in combination: Element 1: wherein the two or more shaped cutting features are four or more shaped cutting features. Element 2: wherein the two or more shaped cutting features are six or more shaped cutting features. Element 3: wherein the two or more shaped cutting features are eight or more shaped cutting features. Element 4: wherein the two or more shaped cutting features are ten or more shaped cutting features. Element 5: wherein the two or more shaped cutting features are angled outward by an angle (φ) ranging from 0.5 degrees to 20 degrees. Element 6: wherein each of the two or more shaped cutting features has one or more teeth extending at least partially from a radial exterior point to a radial interior point thereof. Element 7: wherein the one or more teeth are one or more rounded teeth. Element 8: wherein the one or more teeth are one or more sharp teeth. Element 9: wherein each of the two or more shaped cutting features has three or more teeth extending at least partially from a radial exterior point to a radial interior point thereof.

Those skilled in the art to which this application relates will appreciate that other and further additions, deletions, substitutions and modifications may be made to the described embodiments.

What is claimed is:

1. A cutting element, comprising:

a cutting section, the cutting section including a cutting section outer perimeter edge and a cutting section CenterPoint (CP) defining a distance (d), a cutting section thickness ($t_c$) and a cutting face; and two or more shaped cutting features extending from the cutting face, wherein each of the two or more shaped cutting features is convex shaped having a peak and two edges, the peak angling continuously inwardly and downwardly from a radial exterior point of its shaped cutting feature to a radial interior point of its shaped cutting feature, wherein the two or more shaped cutting features come together proximate the CenterPoint (CP).

2. The cutting element as recited in claim 1, wherein the two or more shaped cutting features are four or more shaped cutting features.

3. The cutting element as recited in claim 1, wherein the two or more shaped cutting features are six or more shaped cutting features.

4. The cutting element as recited in claim 1, wherein the two or more shaped cutting features are eight or more shaped cutting features.

5. The cutting element as recited in claim 1, wherein the two or more shaped cutting features are ten or more shaped cutting features.

6. The cutting element as recited in claim 1, wherein the peak angles inwardly and downwardly by an angle (φ) ranging from 0.5 degrees to 20 degrees.

7. The cutting element as recited in claim 1, wherein each of the two or more shaped cutting features has one or more teeth extending at least partially from the radial exterior point of its shaped cutting feature to the radial interior point of its shaped cutting feature.

8. The cutting element as recited in claim 7, wherein the one or more teeth are one or more rounded teeth.

9. The cutting element as recited in claim 7, wherein the one or more teeth are one or more sharp teeth.

10. The cutting element as recited in claim 1, wherein each of the two or more shaped cutting features has three or more teeth extending at least partially from a radial exterior point to a radial interior point thereof.

11. The cutting element as recited in claim 1, wherein each of the two or more shaped cutting features angles continuously inwardly and downwardly more than half of the distance (d).

12. The cutting element as recited in claim 1, wherein the two edges angle continuously inwardly and upwardly from the radial exterior point of its shaped cutting feature to the radial interior point of its shaped cutting feature.

13. The cutting element as recited in claim 12, wherein the two edges angle inwardly and upwardly by an angle (θ) ranging from 0.5 degrees to 40 degrees.

14. A drill bit, comprising:

a bit body;

one or more blades attached to the bit body;

one or more pockets formed in the one or more blades; and one or more cutting elements fixed in the one or more pockets, wherein each cutting element includes:

a cutting section, the cutting section including a cutting section outer perimeter edge and a cutting section CenterPoint (CP) defining a distance (d), a cutting section thickness ($t_c$) and a cutting face; and two or more shaped cutting features extending from the cutting face, wherein each of the two or more shaped cutting features is convex shaped having a peak and two edges, the peak angling continuously inwardly and downwardly from a radial exterior point of its shaped cutting feature to a radial interior point of its shaped cutting feature, wherein the two or more shaped cutting features come together proximate the CenterPoint (CP).

15. The drill bit as recited in claim 14, wherein the two or more shaped cutting features are four or more shaped cutting features.

16. The drill bit as recited in claim 14, wherein the two or more shaped cutting features are six or more shaped cutting features.

17. The drill bit as recited in claim 14, wherein the two or more shaped cutting features are eight or more shaped cutting features.

18. The drill bit as recited in claim 14, wherein the two or more shaped cutting features are ten or more shaped cutting features.

19. The drill bit as recited in claim 14, wherein the peak angles inwardly and downwardly by an angle (φ) ranging from 0.5 degrees to 20 degrees.

20. The drill bit as recited in claim 14, wherein each of the two or more shaped cutting features has one or more teeth extending at least partially from the radial exterior point of its shaped cutting feature to the radial interior point of its shaped cutting feature.

21. The drill bit as recited in claim 20, wherein the one or more teeth are one or more rounded teeth.

22. The drill bit as recited in claim 20, wherein the one or more teeth are one or more sharp teeth.

23. A well system, comprising:

a wellbore formed through one or more subterranean formations; and a drill bit located in the wellbore, the drill bit including:

a bit body;

one or more blades attached to the bit body;

one or more pockets formed in the one or more blades; and one or more cutting elements fixed in the one or more pockets, wherein each cutting element includes:

a cutting section, the cutting section including a cutting section outer perimeter edge and a cutting section CenterPoint (CP) defining a distance (d), a cutting section thickness ($t_c$) and a cutting face; and two or more shaped cutting features extending from the cutting face, wherein each of the two or more shaped cutting features is convex shaped having a peak and two edges, the peak angling continuously inwardly and downwardly from a radial exterior point of its shaped cutting feature to a radial interior point of its shaped cutting feature, wherein the two or more shaped cutting features come together proximate the CenterPoint (CP).

* * * * *